US005203129A

United States Patent [19]

Johnson

[11] Patent Number: 5,203,129

[45] Date of Patent: Apr. 20, 1993

[54] WINDOW INSULATOR

[76] Inventor: Brenis E. Johnson, P.O. Box 741514, Houston, Tex. 77274-1514

[21] Appl. No.: 708,732

[22] Filed: May 31, 1991

[51] Int. Cl.[5] ..... E06B 3/26

[52] U.S. Cl. ..... 52/202; 52/404

[58] Field of Search ..... 52/202, 203, 475, 476, 52/309.1, 404, 406; 49/63, 463; 160/354.1, 368.1

[56] References Cited

U.S. PATENT DOCUMENTS

| | | | |
|---|---|---|---|
| 4,409,758 | 10/1983 | Dickerson | 52/202 X |
| 4,416,096 | 11/1983 | Schuster et al. | 52/406 X |
| 4,450,660 | 5/1984 | Dean et al. | 52/202 |
| 4,562,675 | 1/1986 | Baigas, Jr. et al. | 52/404 |

*Primary Examiner*—David A. Scherbel
*Assistant Examiner*—Creighton Smith
*Attorney, Agent, or Firm*—William E. Shull

[57] ABSTRACT

A window insulator comprising an insulator core of lightweight rigid insulating materials and/or flexible foam materials, the flexible foam materials being employed at least around the periphery of the core, enclosed by a cover for placement in a window for blocking the entry of sunlight into the interior portion of the structure, for reducing the level of sound energy passing through the window, and for substantially preventing or reducing the transfer of heat through the window. The insulator core may comprise a one-piece body of lightweight, relatively rigid but slightly hand-compressible insulating material. Alternatively, the core may comprise flexible foam material. Alternatively, the core may comprise an interior body of lightweight rigid insulating materials, and flexible, resilient foam members affixed to the peripheral edges of the interior body. The foam members may be affixed to the edges of the interior body by an adhesive, or they may be retained around the edges of the interior body within a saddle of lightweight fabric extending outwardly from the interior body and affixed to the opposite faces of the interior body through a skirt of relatively heavy-duty fabric, which is stitched or otherwise affixed to the inner core portion. A cover is removably mounted around the core. A port may be provided through the insulator.

29 Claims, 21 Drawing Sheets

WINDOW INSULATOR

BACKGROUND OF THE INVENTION

1. Field of the Invention

The present invention relates generally to insulating products, and more particularly to window insulators comprising an insulator core of lightweight rigid insulating materials and/or flexible foam materials, the flexible foam materials being employed at least around the periphery of the core, enclosed by a cover for placement in a window of a house or other structure for blocking the entry of sunlight into the respective room or other interior portion of the structure, for reducing the level of sound energy passing through the window in order to better acoustically isolate the interior of the structure, and for substantially preventing or reducing the transfer of heat through the window in order to better thermally isolate the interior of the structure.

2. Background Art

It is sometimes necessary or desirable to reduce or substantially eliminate the sunlight which enters a room or other interior portion of a building or structure, such as a house or other habitable enclosure, from the exterior thereof. Such blockage of sunlight may be desirable, for example, if one of the inhabitants of the structure worked nights and was required to sleep during daylight hours, if he or she were ill and desired a low level of natural illumination to facilitate bed rest, or simply for the privacy of such persons. In addition, the personal taste of the inhabitants in decorating may find its expression in a darkened room effect. Various other reasons for desiring or requiring a darkened room during daylight hours will no doubt be apparent to those skilled in the art.

Various means have been employed in the past to reduce or substantially eliminate the amount of sunlight entering a room from the outside, such as window shades, blinds, curtains, shutters, louvers, or the like. A wide variety of each type of such conventional window coverings is now available to the consumer, in a wide variety of materials. For example, horizontal blinds may now be purchased in the mini or micro styles, in addition to the well known wider Venetian style, and vertical blinds are also popular. Shades, for example, may be the well known spring loaded rolled shades, or they may be comprised of bamboo strips, reeds, or the like woven together in a roll-up mat, such as the so-called Roman shades, or they may be pleated or fold-up style, somewhat like an accordian. Materials used for window coverings such as the foregoing include wood, fabric, metals, and plastic. One plastic material which has gained popularity of late, particularly for blinds, is vinyl or a similar plastic.

While each of these prior art types of window covering serves to block, more or less, the sunlight entering a room, and each of them may have other desirable characteristics, relatively speaking, such as an aesthetic appearance, competitive cost, or ease of cleaning or operation, none of them possesses all of these attributes while at the same time providing significant reduction or substantial prevention of the passage of heat through the window, or of the passage of sound energy through the window. That is, none of the prior art window coverings used in the past provides substantially complete blockage of sunlight entering a room, as well as significant thermal and sound insulating of the window, so as to tend to thermally and acoustically isolate the room.

In the present days of high-cost energy, particularly that which comes from hydrocarbons, the importance of improving thermal insulation of structures around us need not be belabored here. Suffice it to say that when a structure is supposed to be cooler inside than the exterior air, a bare or inadequately covered window serves as a prime vehicle for the ingress of solar radiation and heat from outdoors, thereby requiring more air conditioning or the like to keep the inside cool. Likewise, when it is supposed to be warmer inside than outside, a bare or inadequately covered window can also serve as a prime vehicle for the loss of heat to the outside, thereby requiring additional heat and energy consumption from the furnace or the like inside the house or other structure in order to compensate for the heat loss.

The desirability or necessity of reducing or substantially eliminating the passage of sound through windows often goes hand in hand with that of darkening the rooms. For example, such sound insulation may be desired to quiet the room to allow the inhabitant to sleep or rest, to produce a desired decorative effect, or simply to reduce or substantially eliminate the so-called noise pollution, that is, unwanted, intrusive background or ambient noise, so prevalent of late. The deleterious effects of noise pollution in a modern industrialized and consumer-oriented society such as ours are well known, and the amount of noise pollution to which we are exposed each day is on the increase.

Various means have been used in the past for reducing the transfer of heat through a window and/or reducing the passage of the sun's rays through a window. For example, double-paned windows with an insulating space between the panes have been used for their insulating effect. Such double-paned windows still allow sunlight through the window, however, along with an amount of the sun's radiant energy. Tinted glass is sometimes used to cut down on the passage of radiant energy through the window. Plastic films or the like which adhere to the surface of a glass window pane have also been used to reduce the passage of radiant energy through the window. It is believed that tinted materials mounted in aluminum frames have been employed for placement on the exterior of a window for the same effect.

As for sound insulation, it is believed that blocks of plastics materials such as polyethylene and polyurethane have been mounted, as by an adhesive or other means, to walls and/or ceilings of a room to reduce the ambient sound level in the room. It is believed that such materials have not, however, been so employed to reduce the passage of sound through a window.

SUMMARY OF THE INVENTION

The present invention comprises simple and effective means and methods for reducing or substantially eliminating the sunlight which enters a room or other interior portion of a building or structure, such as a house or other habitable enclosure, through a window from the exterior thereof. The present invention accomplishes this blockage of sunlight while at the same time reducing or substantially eliminating the amount of sound passing through the window, and also reducing or substantially eliminating the transfer of heat between the interior and the exterior of the building through the window. Thus, the present invention serves as an effective acoustic and thermal insulator, as well as a means of darkening a room by substantially blocking entry of sunlight through the window(s) present in the room. The present invention thus creates an insulated barrier on the interior side of a window.

The present invention comprises an insulator core of lightweight rigid insulating materials and/or flexible foam materials, the flexible foam materials being employed at least around the periphery of the core, enclosed by a cover for placement in a window of a house or other structure. According to one embodiment of the present invention, the insulator core comprises a body of flexible, resilient foam material. According to another embodiment of the invention, the insulator core comprises a body of lightweight rigid insulating material which is somewhat resilient and slightly hand-compressible. According to another embodiment of the present invention, the insulator core comprises an interior body of lightweight rigid insulating materials, and flexible, resilient foam members affixed to the peripheral edges of the interior body. In one embodiment of the invention, such flexible, resilient foam members may be affixed to the edges of the interior body by a suitable adhesive. In another embodiment of the invention, the flexible, resilient foam members may be retained around the edges of the interior body within a saddle of lightweight fabric extending outwardly from the interior body and affixed to the opposite faces of the interior body through a skirt of relatively heavy-duty fabric, which may be stitched to the interior body with relatively heavy-duty cord, twine, or the like.

The insulator core of the present invention is contained within a cover of a suitable decorative material such as a flexible plastic, an animal hide or leather, or a cloth fabric, preferably one that is washable or dry cleanable in order to keep up the appearance of the present invention. The covers of the present invention are preferably made in sections so that the insulator cores may be easily placed within them. The covers may also be made so that they are essentially one piece, with a flap on one end which may be raised to allow insertion of the insulator cores within them, and secured shut with fastening means. According to one embodiment of the invention, the cover comprises a lower, opentop enclosure or box section for covering the entire insulator core except for the interior portion of one face, and an upper closure flap which is removably affixed to the lower box section for completing the enclosure of the insulator core. According to another embodiment of the invention, the cover comprises a middle frame section for covering the edges of the insulator core and the peripheral portions of each of the two opposing faces, being open at the interior portions of each of the two opposing primary faces in like manner as the embodiment previously referred to with regard to its one partially open face, and closure flaps removably affixed to the opposite sides of the frame section to enclose each of the respective faces of the insulator core, again in like manner as the upper closure flap previously referred to in connection with the first embodiment completes the enclosure of the corresponding partially open face.

The insulator core is inserted into the one-piece cover with the flap raised, or into the box or frame section of the cover, as the case may be, and the closure flap or flaps is/are affixed in place, thereby completing the cover. The window insulator of the present invention, including the insulator core, any flexible foam members surrounding the core, and the material comprising the cover and the saddles, if any are used, is preferably sized slightly larger than the receptacle in which it will be placed, that is, the enclosed area around the window, so that the completed window insulator should preferably be squeezed or compressed slightly in an inward direction in order to fit it in the window. With such a slight squeeze fit, the insulator of the present invention will tend to remain in place by friction.

In the event that it is desired occasionally to see out of the window or to allow some sunlight to enter the room without removing the entire insulator, the insulator core of the present invention may be provided with a removable plug forming a port or the like through the core. The plug may be removed when desired, thereby permitting one to see through the port and allowing sunlight to enter therethrough, and replaced when desired, preventing such viewing and passage of sunlight therethrough. The closure flaps of the cover are preferably provided with port closure sections for covering the plug. The port or bore through the insulator core is lined with the cover material so that when the plug is removed, the cover material and not the core material will be visible.

BRIEF DESCRIPTION OF THE DRAWINGS

These and other features and advantages of the present invention will become apparent as the following detailed description of preferred embodiments thereof is read in conjunction with reference to drawings, wherein:

FIG. 1 is an exploded view of the assembly of another alternative embodiment of the window insulator of the present invention, utilizing an insulator core having an inner portion of lightweight rigid insulating material and flexible, resilient foam members affixed, as by an adhesive, to its peripheral edges, and a closure flap for the cover having corner retaining flaps on its inner face for receiving a piece or sheet of reinforcing and insulating material, this embodiment also including a port in the core, a plug for the port, a port liner for the cover, a hole in the box section of the cover, and plug closure sections for the cover;

DETAILED DESCRIPTION OF THE PREFERRED EMBODIMENTS OF THE INVENTION

Figure 3A:
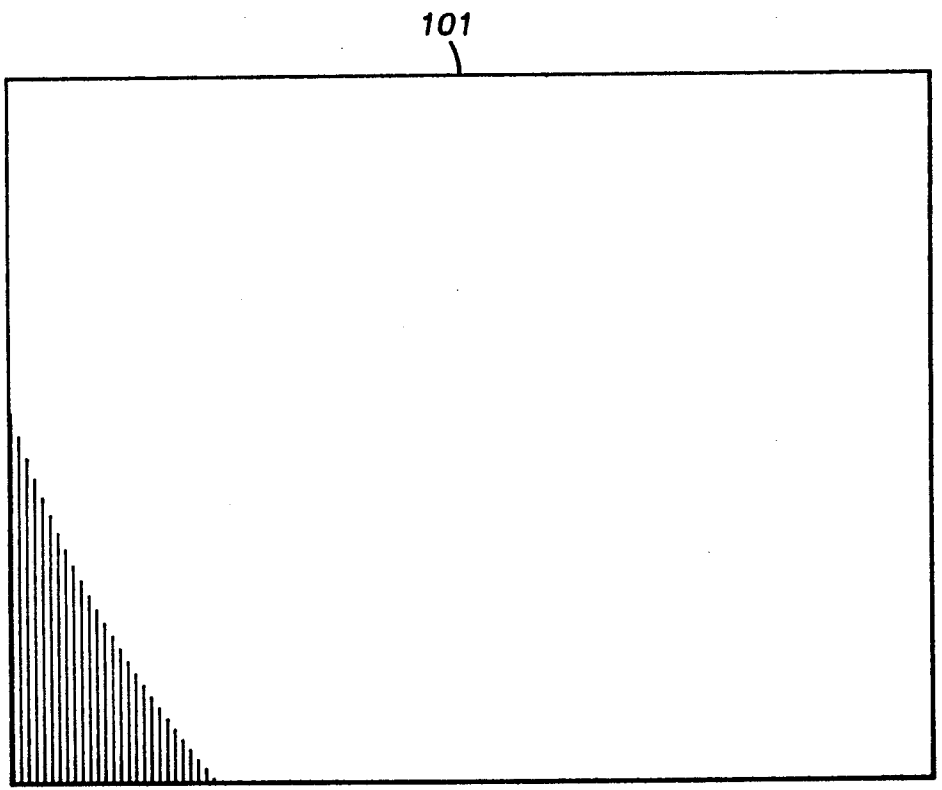
FIGS. 3A, 3B, and 3C are plan, side elevational, and end elevational views, respectively, of an insulator core of one preferred embodiment of the invention, comprising a body of flexible, resilient foam material.
Figure 3B:
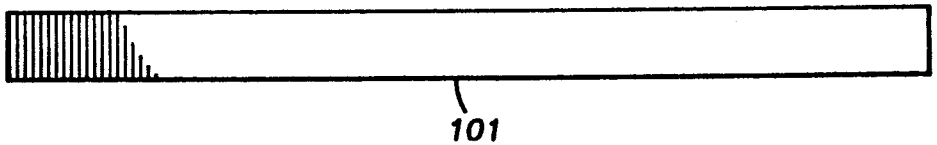
Figure 3C:
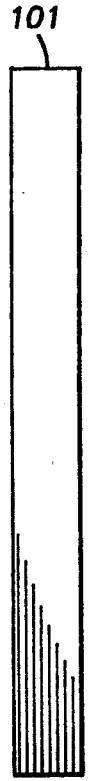

Referring initially to FIGS. 3A-3C, there is shown at 101 a preferred configuration of an insulator core of a window insulator of the present invention. According to one embodiment of the present invention, the insulator core 101 comprises a body of flexible, resilient material, such as a plastics foam. According to another embodiment of the invention, the insulator core 101 comprises a body of lightweight, relatively stiffer or rigid insulating material which is somewhat resilient and slightly hand-compressible. The core 101 is sized to fit snugly within the enclosure structure around a window on the interior side thereof. The core 101 is preferably slightly larger in its exterior dimensions than the interior dimensions of the enclosure around the window, so that the core should preferably be squeezed or compressed slightly to be placed within the window enclosure. When so squeezed or compressed, the core will tend to remain within the window enclosure by friction. The core should be configured to fit snugly all around the window enclosure so as to form a seal therewith. Accordingly, the core should have roughly the same shape as the window enclosure. The core 101 as shown is rectangular, but it should be understood that any shape of core can be used depending on the shape of the window to be covered. The core material should be thick enough to provide the desired insulating effects, such as several inches in thickness, but preferably should not be thicker than the depth of the window enclosure so as not to protrude therefrom into the room.

The material used for the core 101 should possess good thermal and acoustic insulating properties, and be relatively durable and resistant to deterioration when the window insulator is exposed to direct sunlight, and from exposure to ambient heat and ambient cold. For the embodiment of the core comprising a body of flexible, resilient material, a material such as flexible polyurethane foam or other natural or synthetic foam rubbers or plastics may be employed. It is believed that a core composed entirely of such flexible, resilient material should be used only for relatively small windows, since such a core may not have the structural strength to retain its shape without sagging in larger windows, and such a core may tend to fall out of a larger window more easily. For the embodiment of the core comprising a body of lightweight, relatively stiffer or rigid insulating material which is somewhat resilient and slightly hand-compressible, a material such as rigid polyethylene, rigid polyurethane, or the like may be used. A core composed entirely of one of the latter two types of materials will have to be sized and shaped more precisely to the window, since such cores may not be squeezed or compressed as much as the flexible cores in order to fit them within the window enclosures. That is, for a one-piece core, the latter type of core cannot be as oversized with respect to the window enclosure as the flexible core, and the shape of the latter type of core should more closely approximate the shape of the window than the flexible core. It should be understood that in the event a large window is to be covered, such as a long, narrow window, a plurality of window insulators which fit snugly together to cover the entire window may be employed.

Figure 15A:
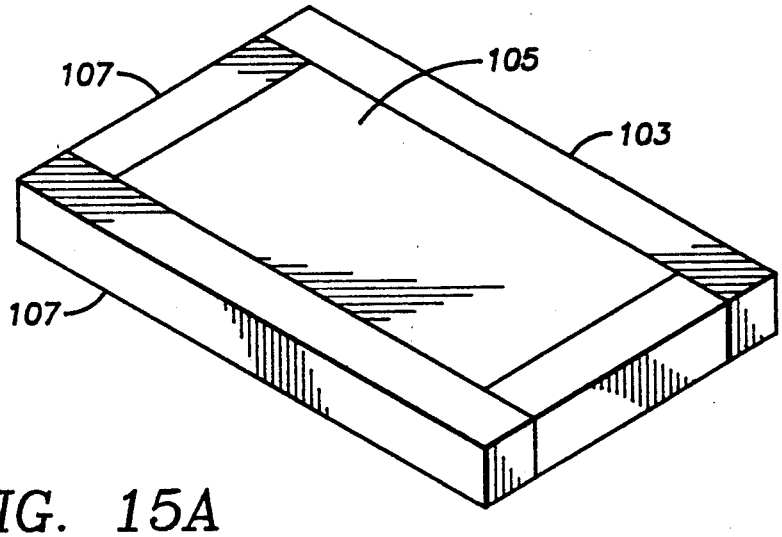
FIG. 15A is an isometric view.
Figure 15B:
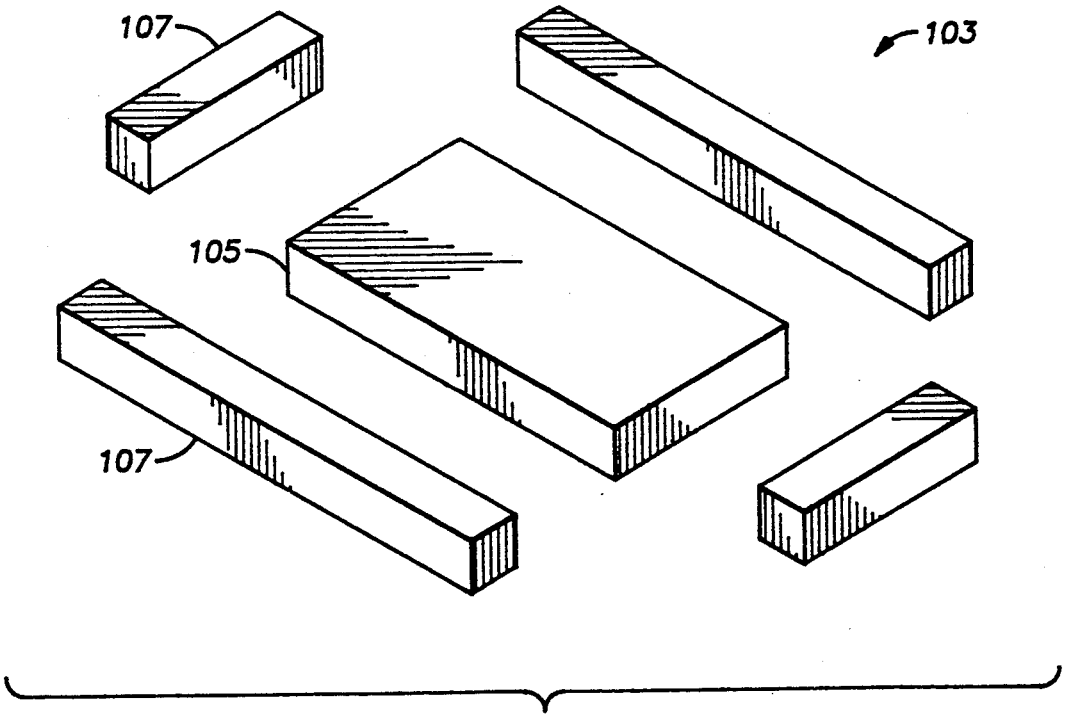
FIG. 15B is an exploded isometric view, of an insulator core similar to the one shown in FIG. 14, but without a port.

The window insulator according to the invention may also comprise a composite core having interior portions composed of a lightweight rigid insulating material. Referring to FIGS. 15A and 15B, an alternative insulator core 103 is shown. Insulator core 103 comprises an inner core portion 105 of lightweight rigid insulating material, and a plurality of flexible, resilient foam members 107 affixed to the peripheral edges of the inner core portion 105. The material used for foam members 107 should possess good thermal and acoustic insulating properties, and should be relatively easily hand-compressible into the window enclosure. Foam members 107 are preferably made of flexible polyurethane foam or the equivalent. The material used for the inner core portion 105 should be relatively lightweight, relatively rigid or stiff, possess good thermal and acoustic insulating properties, and also be relatively durable and resistant to deterioration when the window insulator is exposed to direct sunlight, and from exposure to ambient heat and ambient cold. A material such as rigid polyurethane, polystyrene (styrofoam), or rigid polyethylene may be used for the inner core portion 105, as well as other suitable plastics or other materials. The relative rigidity of the inner core portion 105 gives the composite core shown in FIGS. 15A and 15B greater strength than a core composed of only flexible foam material. The presence of the flexible, resilient foam members around the inner core portion enables the edges of the composite core to be squeezed or compressed into the window enclosure upon installation of the window insulator in order to obtain the desired friction fit. As in the case of the core 101, the core 103 should be sized and configured to fit snugly within the window enclosure so as to form a seal substantially all around the window enclosure. The flexible foam members may be bonded to the edges of the inner core portion 105, and to each other, for example, at the corners of the core, with a suitable adhesive. The adhesive should be one which results in a firm bond between the members 107 and the inner core portion 105, and which does not adversely affect the structural integrity of the bonded materials such as by dissolving them or the like. One adhesive which has been found suitable, for example, for bonding poyurethane foam members 107 to each other and to an inner core portion of styrofoam is Lawson Flexseal Supreme Dispense-A-Gasket, RTV Black Silicone, No. 93844, used according to the label instructions.

Figure 17A:
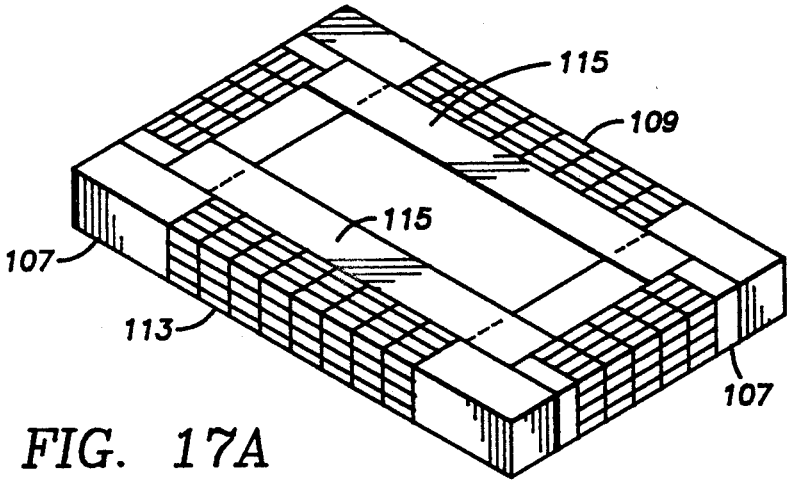
FIGS. 17A and 17B are isometric and exploded isometric views, respectively, of an alternative embodiment of an insulator core for the window insulator of the present invention, including an inner core portion of lightweight rigid insulating material and flexible, resilient foam members affixed around the periphery of the inner core portion with saddles.
Figure 17B:
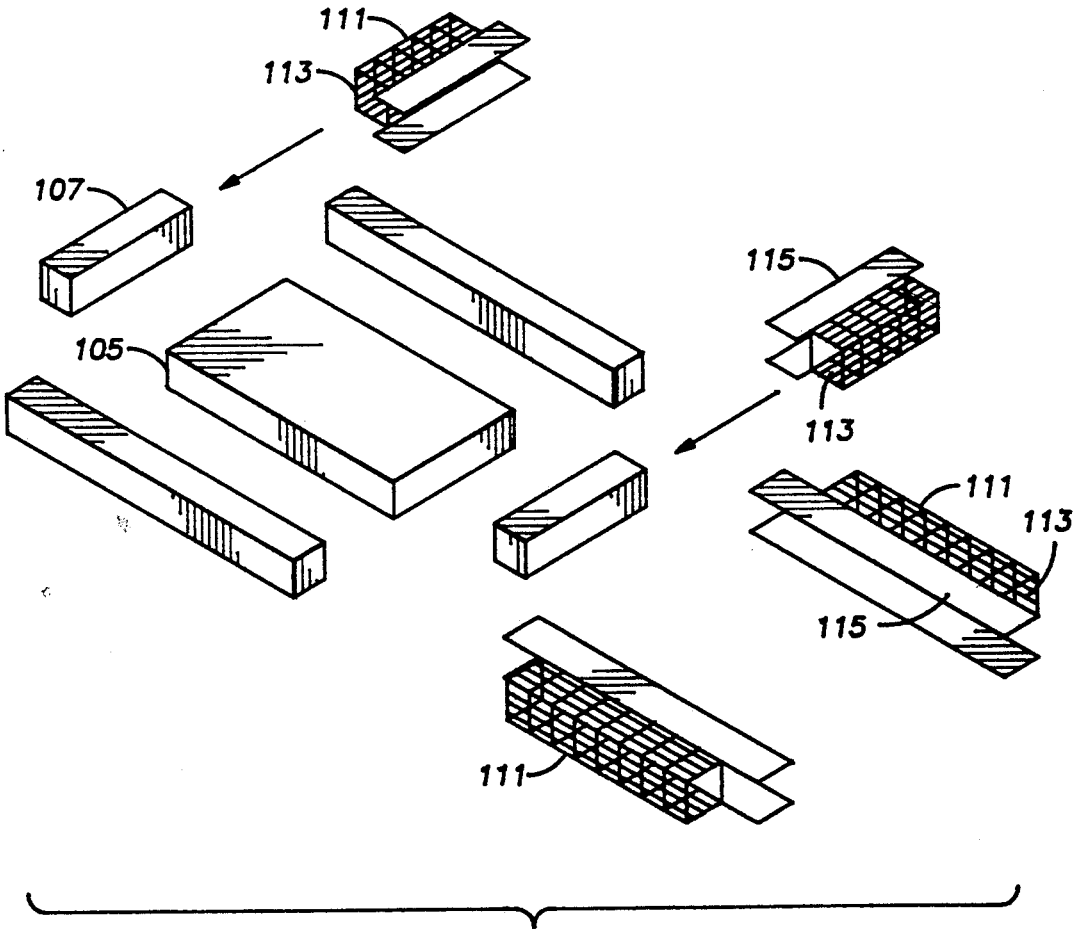
Figure 18C:
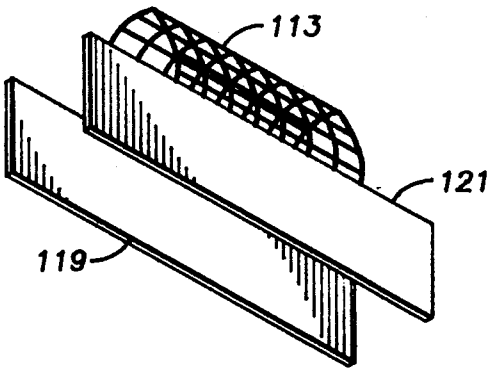
FIGS. 18A, 18B, 18C, and 18D are side elevational, bottom plan, bottom isometric, and end elevational views, respectively, of a saddle for affixing a flexible, resilient foam member to an inner core portion of lightweight rigid insulating material.
Figure 18D:
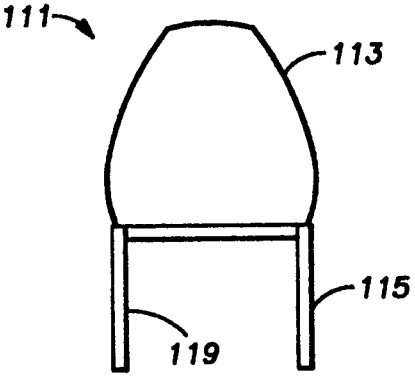
Figure 18A:
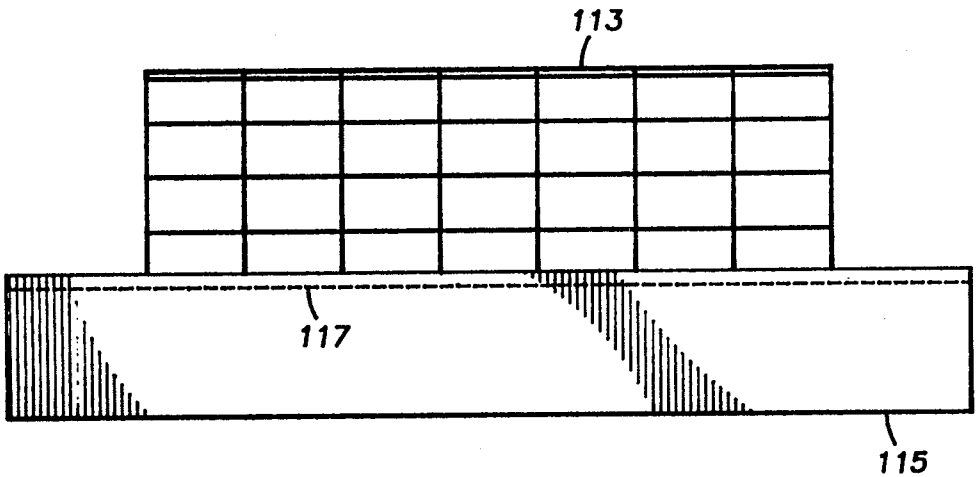
Figure 18B:
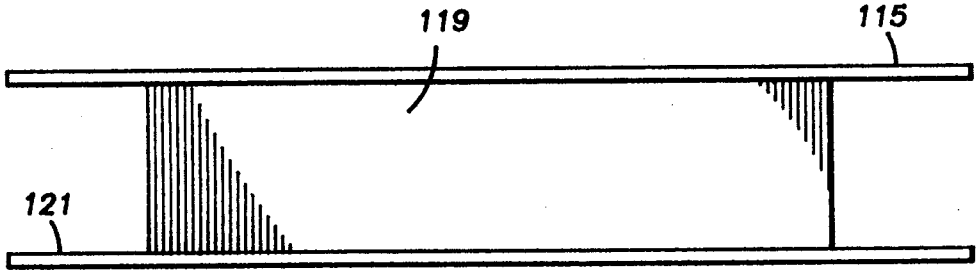

Another alternative for affixing a plurality of flexible, resilient foam members to an inner core portion of lightweight rigid insulating material is shown in FIGS. 17A and 17B. An alternative composite insulator core is generally referred to at 109 in those figures. For ease of reference, the inner core portion in this alternative embodiment is indicated as 105 as shown in FIGS. 15A and 15B, and the foam members affixed around its periphery are indicated as 107. Instead of bonding the foam members 107 to the core 105, in this embodiment the foam members are retained on the core by saddles 111. Referring also to FIGS. 18A through 18D, the saddles each comprise an elongated loop or channel 113 of relatively lightweight material, preferably of a fabric such as a lightweight gauze or other loosely woven or netlike fabric, the longitudinal edges of which on each side are stitched as shown at 117 to a skirt 115 of a relatively more heavy duty, preferably fabric-type material, such as a canvas-type material. The skirt 115 includes a U-shaped midportion 119 which may be, for example, substantially the same length as the channels 113 The channels 113 may be substantially the same length as, or shorter than, the foam members 107. The skirt may also include extension flaps 121 which may extend longitudinally on both sides of the midportion 119 of skirt 111 at each end thereof. It should be understood that the midportion 119 may be relatively longer or shorter than, or flush with, the channels 113; and also that extension flaps 121 may be relatively longer or shorter than those shown in the drawings, or eliminated altogether, as desired. The foam members 107 are received within the channels 113 of the saddles 111, and the lower, longitudinally extending or free edges of the skirts 111 are then preferably stitched along substantially their entire lengths to the opposite faces of the inner core portion 105, preferably with a heavy duty cord or twine, thereby capturing the foam members 107 under the channels 113 between the interior of the channels and the adjacent edges of the inner core portion 105. The completed assembly of this alternative insulator core is shown in FIG. 17A.

Referring now to FIGS. 4A–4C and 7A–7D, if it is desired occasionally to be able to see through the window insulator of the present invention or to let sunlight into the room through the window insulator, the insulator core 101' may be provided with a cut-out portion or port 123 into which a plug 125 will fit, so that the plug 125 can be removed or replaced as desired to either allow or prevent, respectively, viewing or light entry through the core. For this embodiment, it is preferred that a material other than the flexible foam material be used, because when a plug is removed from a core of flexible foam material the remainder of the foam core body may not have sufficient structural strength to keep its shape and/or remain in place in the window. Accordingly, the core 101, preferably is composed of the material such as rigid polyethylene or rigid polyurethane. The plug may preferably be made of the same type of material as the core, and it will be appreciated that the same plug of material which is removed to make port 123 may also be used to form the plug 125. The port 123 in the core is preferably lined with a fabric such as the one employed for the cover so that the plug 125 will fit snugly within the port. The plug 125 should make a snug fit within the port 123 so as to maintain a tight seal therewith. The material covering the plug and lining the port should be taken into account when fitting the plug to the port so as to assure a snug fit. For example, when the same piece of material which is cut out of the core is used for the plug, it will typically have to be trimmed down somewhat to accommodate the thickness of the material 161 lining the port and the material covering the plug itself, to avoid the plug's fitting too tightly in the port. For ease of removal and replacement of the plug 125, the plug may be provided with a handle 127 which may be grasped by the operator in the removal and/or replacement operations. Handle 127 may be, for example, bonded to the plug with a suitable adhesive, or otherwise affixed thereto. The handle could also be constructed into the material covering the plug, or as part of the material covering the plug. That is, the handle could also be made of the same material as the material covering the plug.

The insulator core of the present invention is placed within a protective and decorative cover prior to installation in the window enclosure. The cover is preferably made from a material which can be hand washed, machine washed, vacuumed, brushed, swept, or dry cleaned so as to maintain its appearance. Cloth fabrics, leather, or flexible plastics such as vinyl may be employed, for example. The covers may be provided with a variety of decorative designs, patterns, and/or colors and are made so that the insulator cores will fit either snugly, but not overly tightly so as to deform the cores, or slightly loosely within the covers. The covers may be made in two or more pieces or sections, or they may be made so as to be essentially one piece, as hereinafter described so as to facilitate placing the cores within them. Replacement covers will preferably be available in order to permit replacement of damaged, worn, outmoded, or no longer desirable covers.

Figure 19:
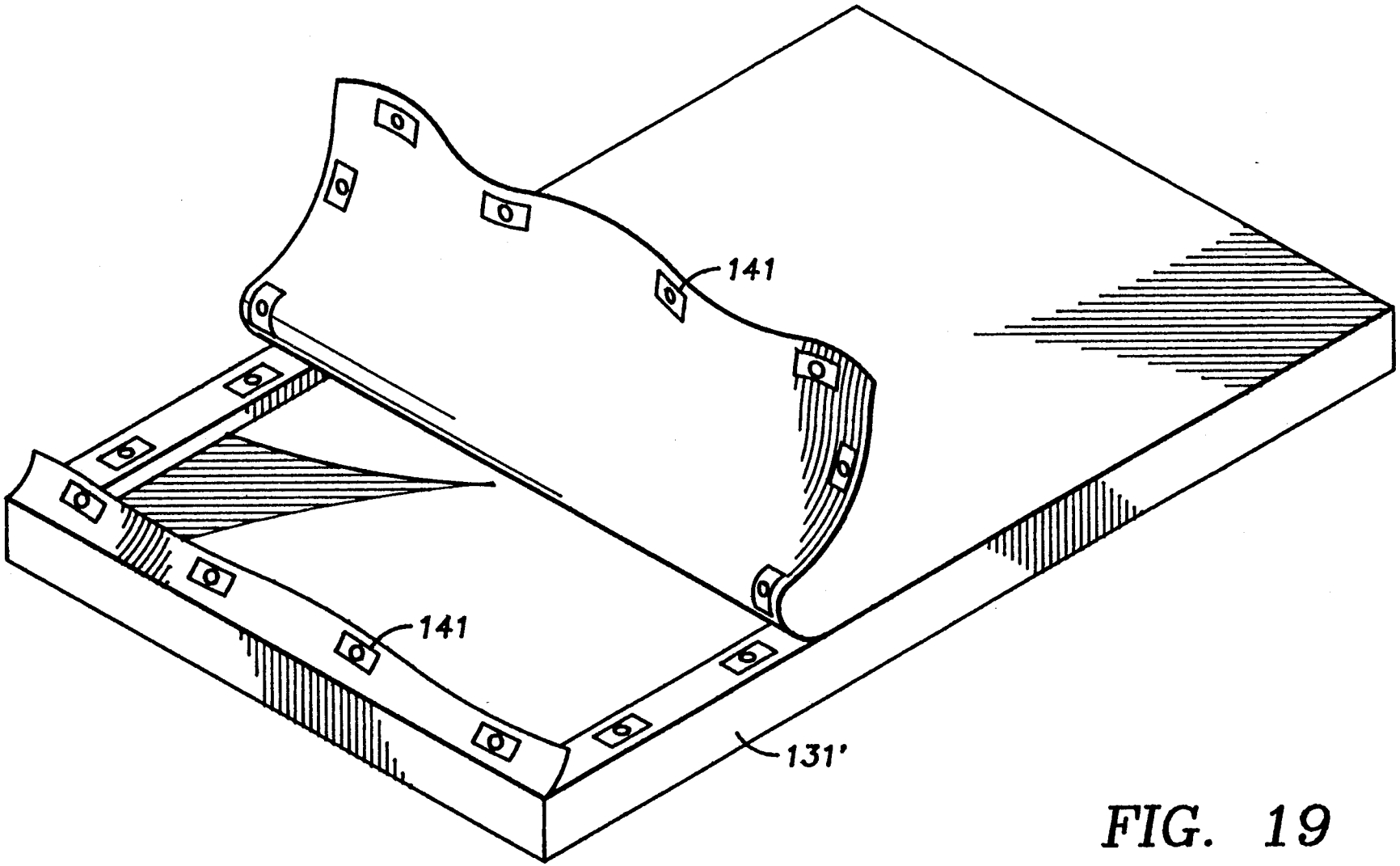
FIGS. 19, 20, 21 and 22 are isometric views of alternative means of removably securing a closure flap to the main body of a cover of a window insulator of the present invention, the covers shown in these views comprising, in effect, a one-piece construction.
Figure 20:
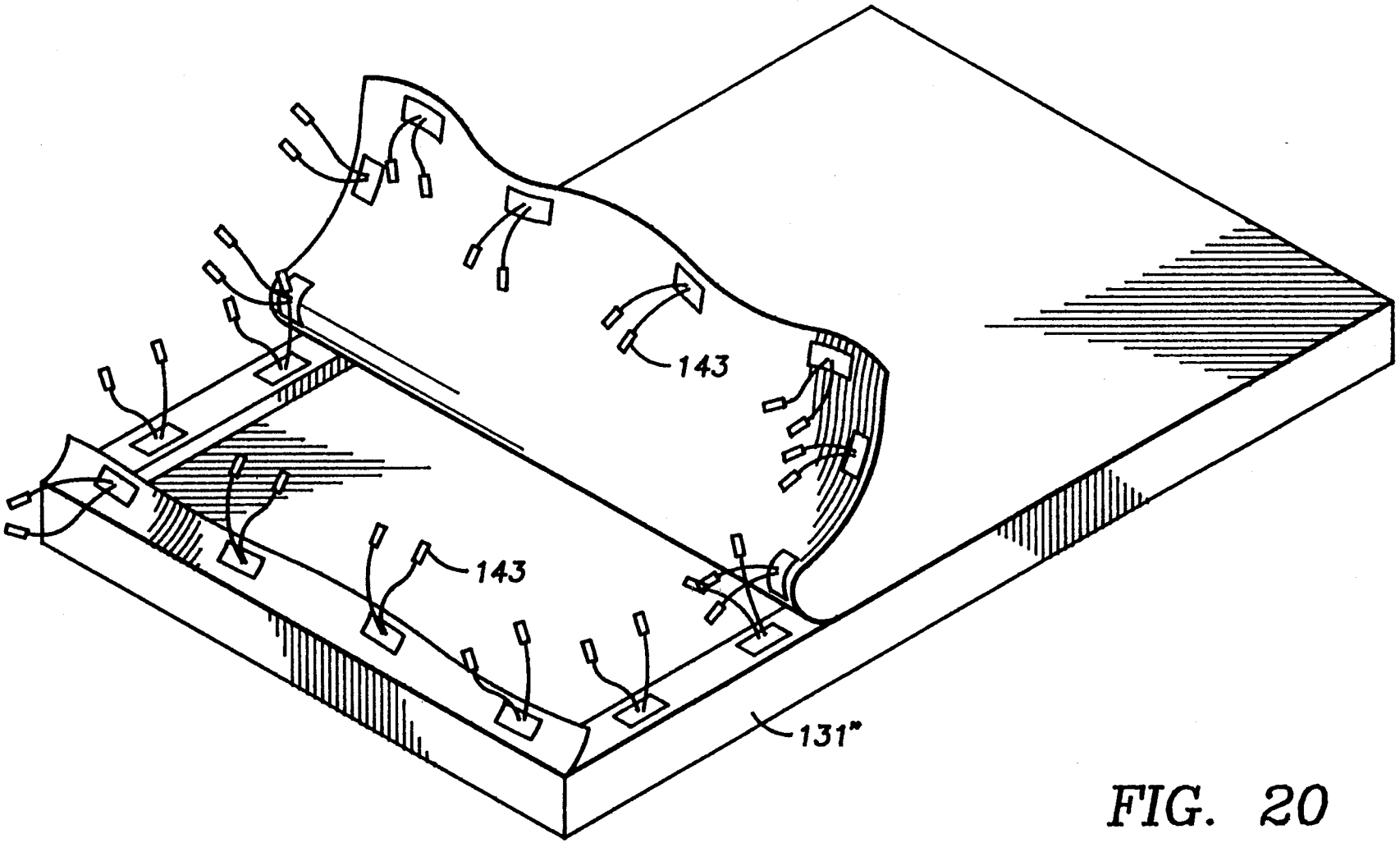
Figure 21:
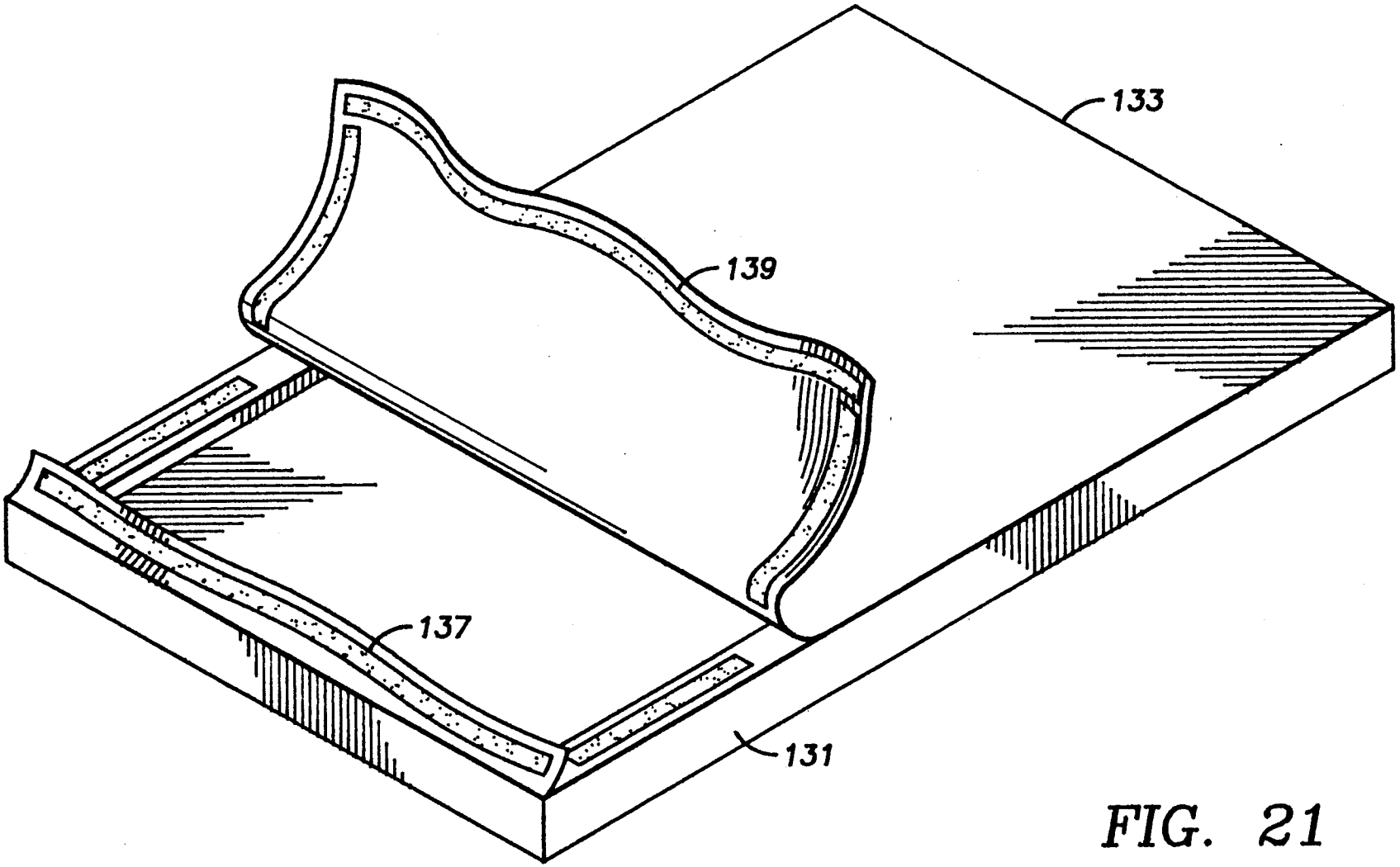
Figure 22:
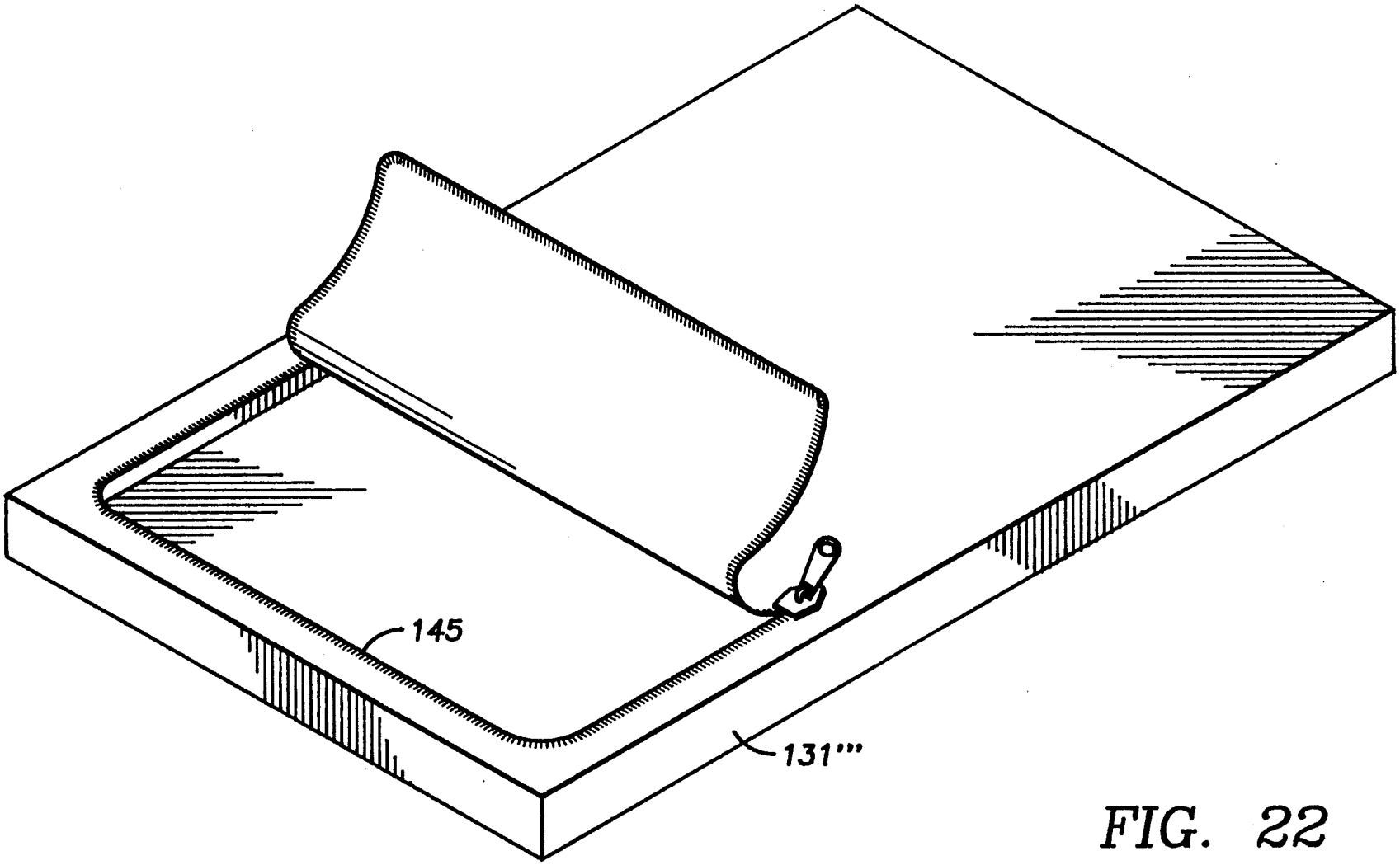

Referring now to FIGS. 1A–1C and 5A–5D, there is shown the cover pieces which may be assembled around an insulator core into one embodiment of window insulator according to the present invention. The cover shown in these figures includes a box section 131 and a closure flap 133. The box section 131, referred to above, using the terms in their conventional senses of a box as having a bottom and a top, as a lower box section, is an opentopped structure adapted for enclosing an insulator core around all sides and faces but one primary face, and in the latter case, the box section partially encloses that primary face from the peripheral edges extending inwardly. The portion of the lower box section which partially encloses the remaining exposed primary face is configured like a flange or border or frame, and includes around its midportion a fastening means 137 adapted for mating engagement with a correlatively shaped fastening means 139 disposed near the periphery of the closure flap 133. The fastening means 137, 139 may comprise, for example, miniature plastic hook and loop fasteners such as those known as Velcro. Other fastening means for removably fastening the closure flap 133 to the lower box section 131 may also be employed, such as those shown in FIG. 19 (snaps 141), FIG. 20 (ties 143), and FIG. 22 (a zipper 145). The embodiment shown in FIG. 21 utilizes Velcro. The cover parts shown in the embodiments of FIGS. 19, 20, and 22 are numbered in a similar manner as the cover parts shown in FIG. 21, except for the use of the "prime" feature, to illustrate similarity of the parts, other than in the fastening means.

Figure 6A:
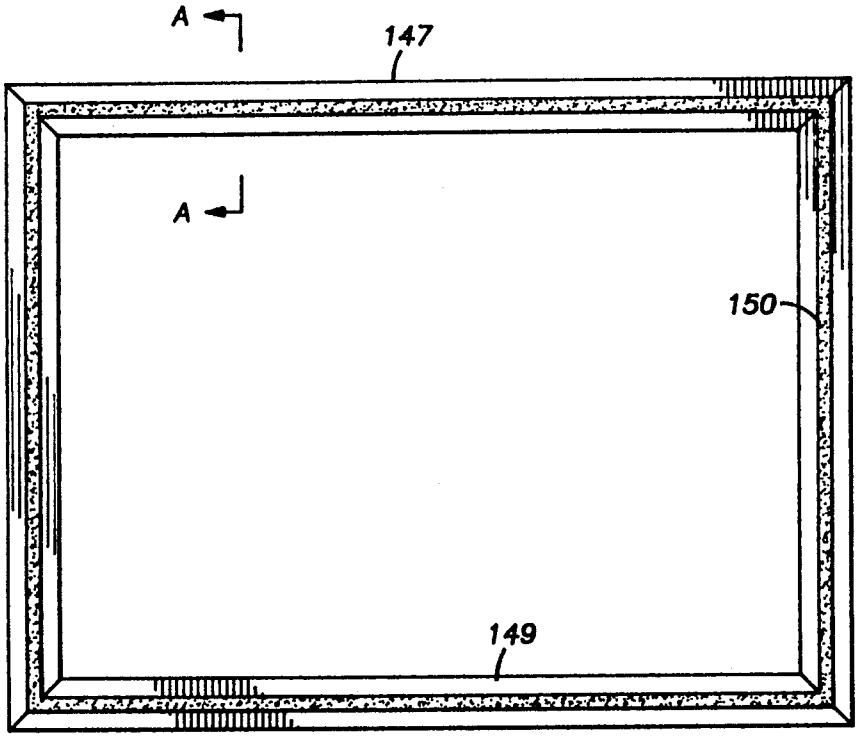
FIGS. 6A, 6B, and 6C are plan, side elevational, and end elevational views, respectively, of a middle frame section for a cover of an alternative preferred embodiment of the present invention.
Figure 6B:
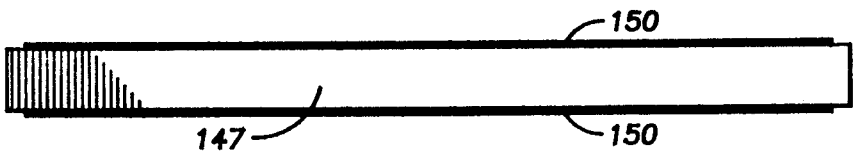
Figure 6C:
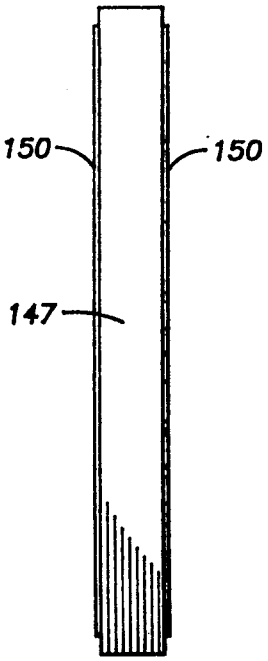
Figure 6D:
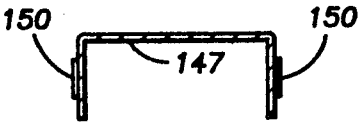
FIG. 6D is a sectional view taken along lines A—A of FIG. 6A.
Figure 7B:
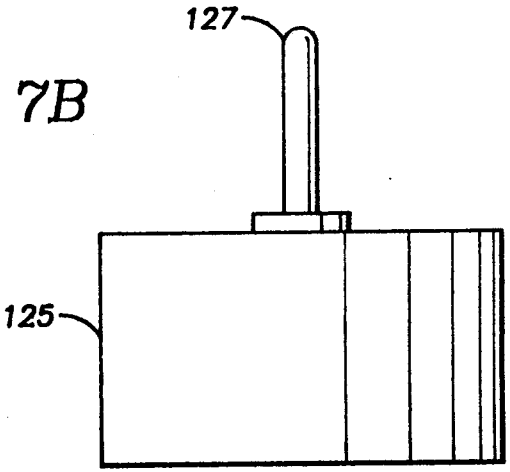
FIGS. 7A, 7B, 7C, and 7D are isometric, side elevational, top plan, and front elevational views, respectively, of a preferred embodiment of a plug for an insulator core of the window insulator of the present invention.
Figure 7D:
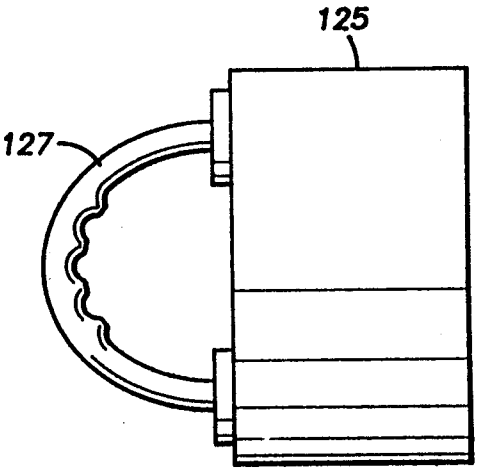
Figure 7A:
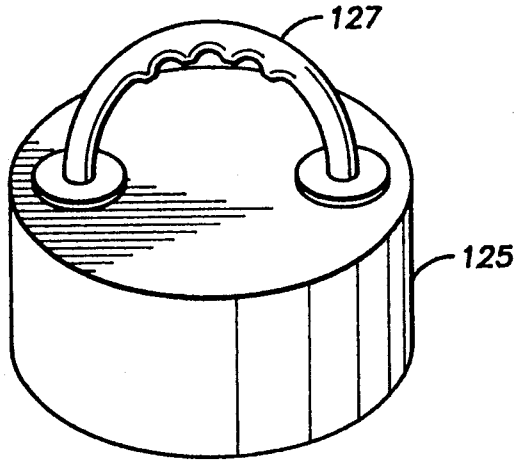
Figure 7C:
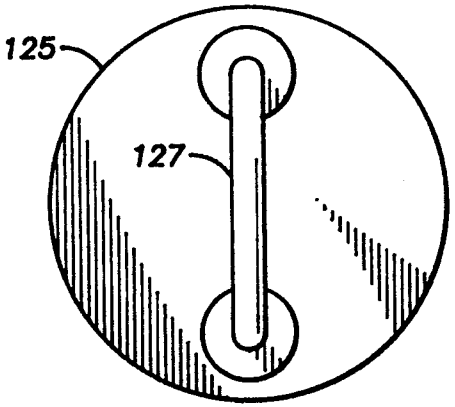

An alternative means for constructing a cover assembly is illustrated in FIGS. 6A–6C. In those figures, a middle frame portion 147 encloses an insulator core around its peripheral edges, but is open in the middle, partially enclosing the opposite primary faces of the insulator core with a border or flange similar to the one shown in FIG. 5A for lower box section 131. Each such frame or border portion 149 includes a fastening means 150, such as a Velcro strip, for mating engagement with another fastener, such as another Velcro strip, disposed on a closure flap, such as flap 133. A pair of flaps 133 may be employed along with middle frame portion 147 to form a cover according to the present invention.

In the event that a port is employed through the insulator core, the cover used with that insulator core will preferably also have an aperture or apertures therein to permit use of the port and accompanying plug for their intended purposes, as referred to above. Referring to FIGS. 2A–2D, one embodiment of closure flap 151 is shown which may be so used. Closure flap 151 is similar to flap 133, but it is further provided with an aperture 153 therein which is in register with the port through the insulator core when assembled. A fastener 155, which may again be a Velcro fastener or other suitable fastener as disclosed herein or equivalent, is disposed on the exterior face of the closure flap so that it may matingly and removably engage a correlative fastener 157 disposed around a plug closure section 159 shown in FIGS. 8A and 8B. The plug closure section 159 is placed over the aperture 153 in flap 151 in order to conceal the plug from view.

Figure 8B:
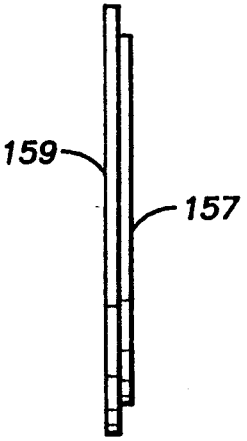
FIGS. 8A and 8B are top plan and side elevational views, respectively, of a plug closure section for a closure flap of a cover as shown in FIGS. 2A, 2B, and 2C.
Figure 9B:
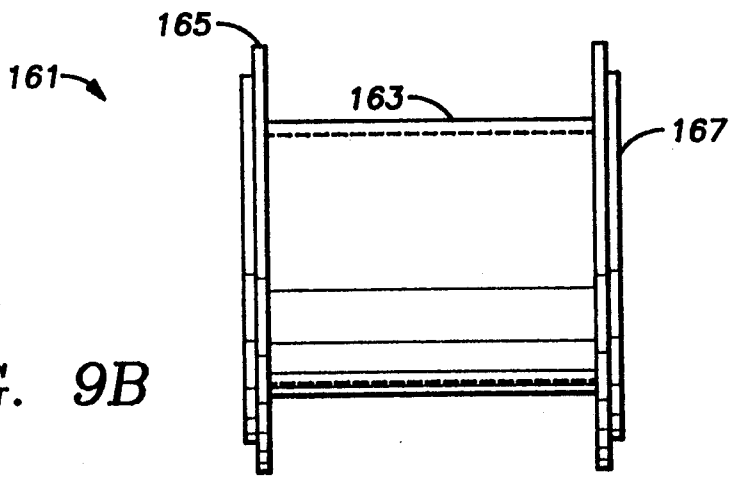
FIGS. 9A and 9B are top plan and side elevational views, respectively, of a liner for a port through an insulator core of the window insulator of the present invention.
Figure 8A:
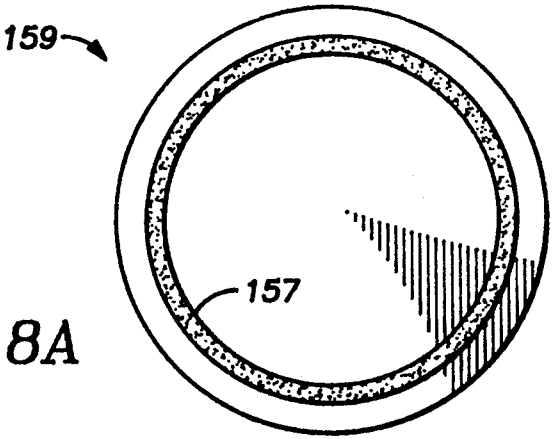
Figure 9A:
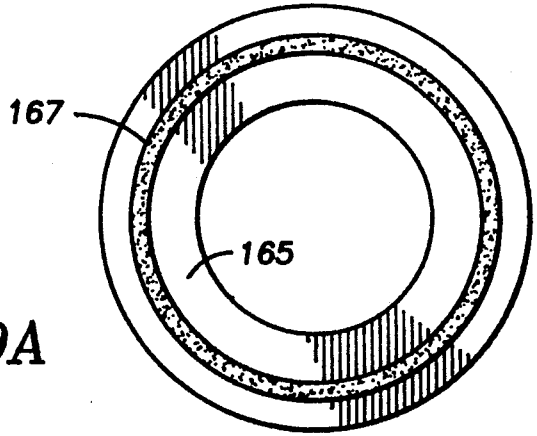

Referring to FIGS. 9A and 9B, there is shown a port liner, comprising part of the cover for the insulator core, which is disposed in the port through the core in order to cover the core material forming the walls of the port with the protective and decorative cover material. The port liner 161 includes a cylindrical portion 163 which is disposed through the port, and an outwardly extending flange portion 165 on each end thereof for overlaying an adjacent part of the cover. The flange portions 165 have fastening means 167, such as Velcro or some other fastener, disposed thereon for receiving and removably securing thereto a plug closure section such as shown in FIGS. 8A and 8B. When a window insulator including a port liner as shown herein is installed and the plug closure sections 159 are removed, thereby opening up the port, the port liner will be visible inside the port so that the decorative effect of the cover will not be lost. The core material may be unsightly, or at least not as decorative as the cover, and preferably is covered by the port liner.

Figure 14:
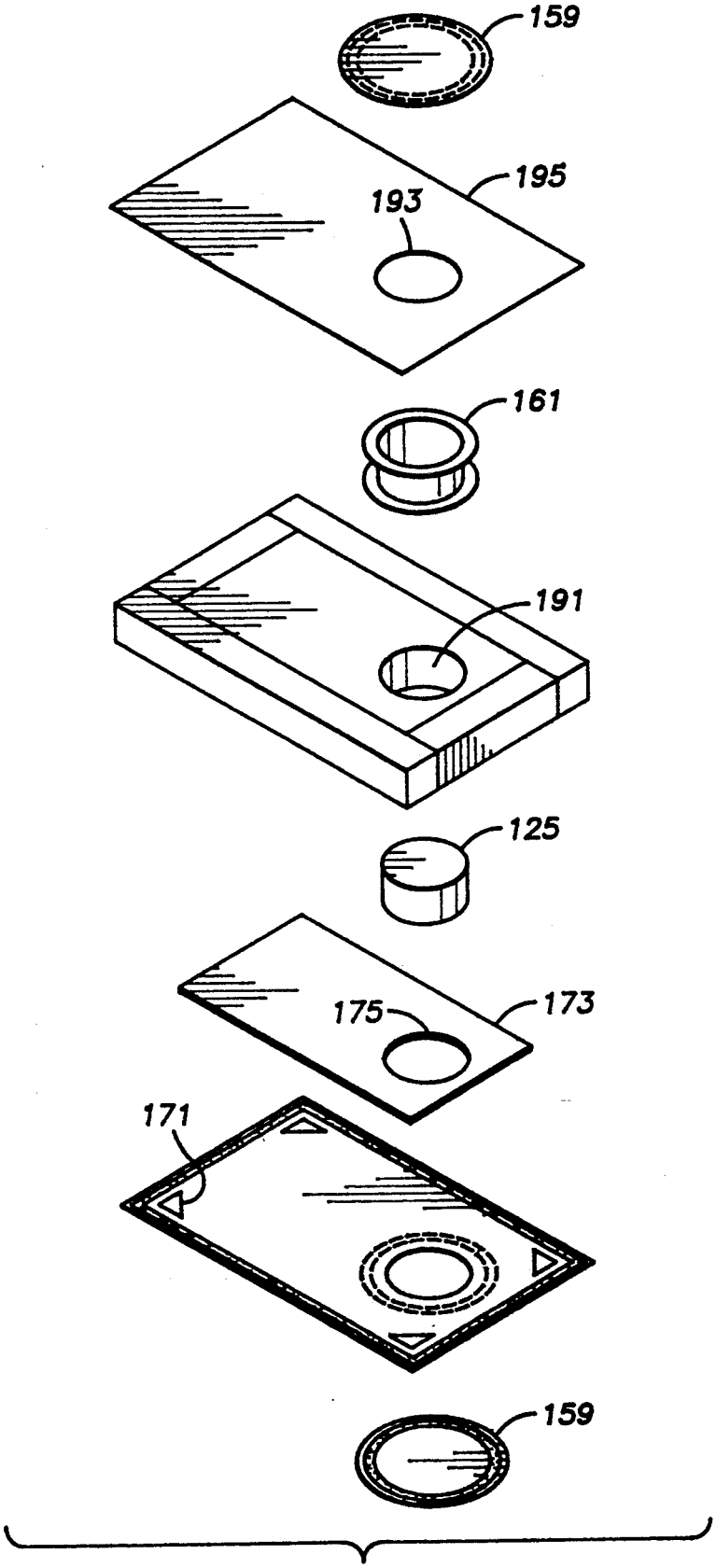
Figure 16:
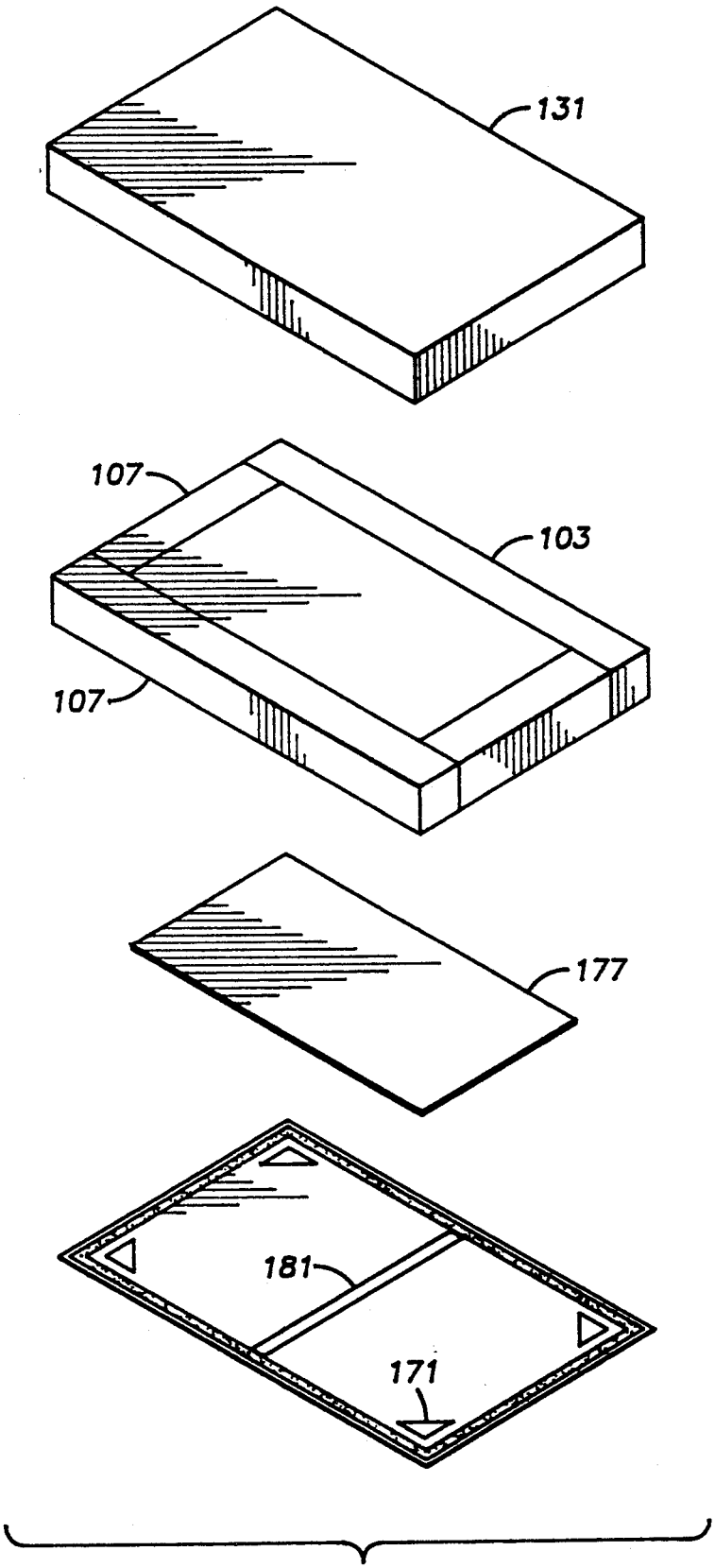
FIG. 16 is an exploded view of another alternative embodiment of a window insulator of the present invention, including an insulator core such as shown in FIGS. 15A and 15B, a box section for the cover as shown in FIGS. 5A-5D, and another alternative embodiment for a closure flap having means for retaining a piece or sheet of reinforcing and insulating material.

Referring now to FIGS. 14 and 16, in the event that greater insulation effects are desired for the window insulator of the present invention, the closure flap may be provided with triangular insert flaps 171 on its interior face for receiving an insert comprising a relatively thin piece or sheet 173 of rigid, semi-rigid, or flexible material such as hard plastic, semi-rigid plastic, flexible plastic, or fiberglass or the like, or quilted cloth or the like. Sheet 173 is preferably thin and lightweight enough so as not to be overly heavy or bulky, but thick enough to provide some additional insulation effects. The corner flaps 171 are adapted to receive therewithin the four corners of the sheet 173. It should be understood that although the embodiments shown in FIGS. 14 and 16 are rectangular, other shapes for the window insulator may be accommodated with correlatively shaped closure flaps and reinforcing and insulating inserts 173. A shown in FIG. 14, insert 173 may be provided with an aperture 175 for accommodating a port through the core. If further support for the insert sheet is desired, then a strap 181 may be provided on the interior side of the closure flap, under which the insert sheet 177 is slipped when assembled. The strap 181 traverses the midportion of the insert sheet 177, which in the embodiment shown does not have an aperture to accommodate a port, in order to further support the sheet in such midportion.

Figure 1C:
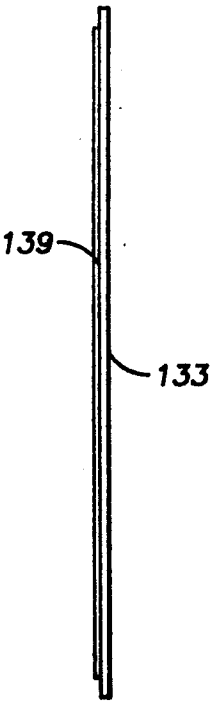
FIGS. 1A, 1B, and 1C are plan, side elevational, and end elevational views, respectively, of one form of a closure flap for a cover according to the preferred embodiments of the present invention.
Figure 1A:
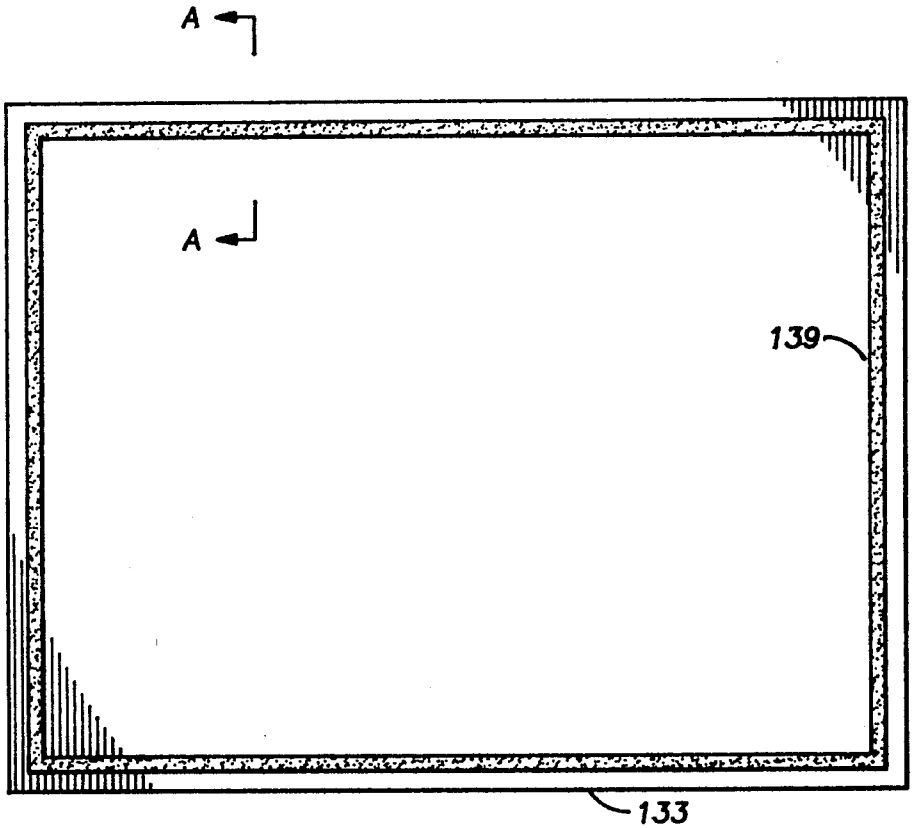
Figure 1B:
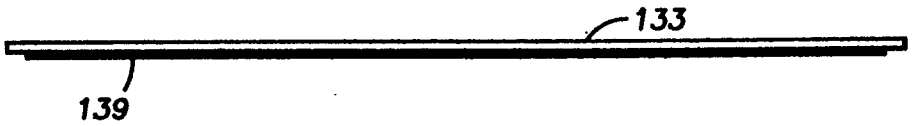
Figure 2A:
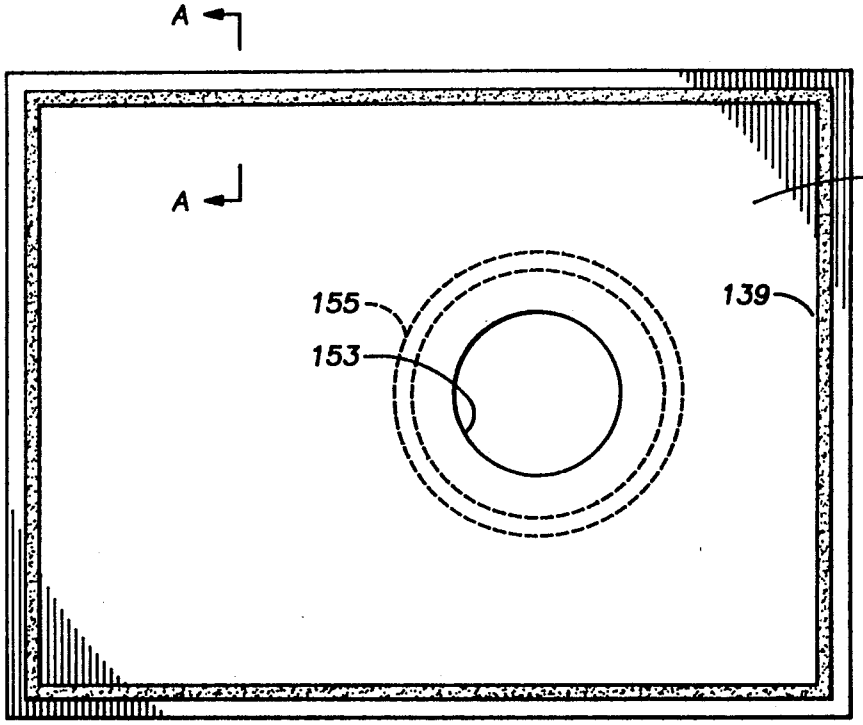
FIGS. 2A, 2B, and 2C are plan, side elevational, and end elevational views, respectively, of a closure flap for a cover of another preferred embodiment of the present invention, including an aperture therein for accommodating a port.
Figure 2C:
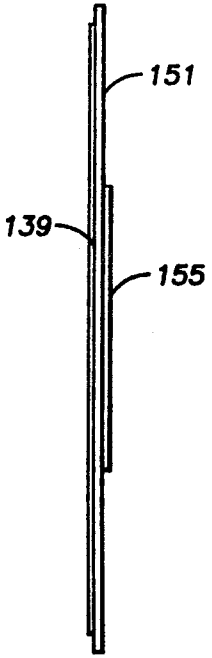
Figure 2B:
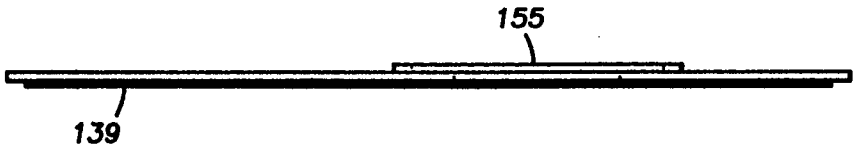
Figure 2D:
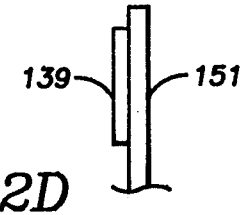
FIG. 2D is a sectional view taken along lines A—A of FIG. 2A.
Figure 4C:
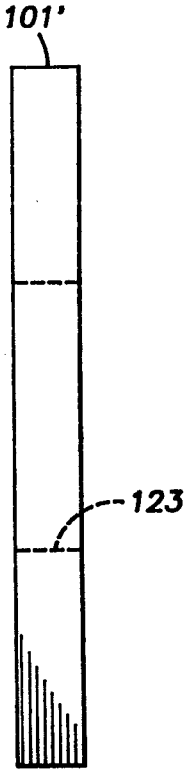
FIGS. 4A, 4B, and 4C are plan, side elevational, and end elevational views, respectively, of an insulator core of another preferred embodiment of the invention, comprising a body of flexible, resilient foam material having a port therethrough.
Figure 4A:
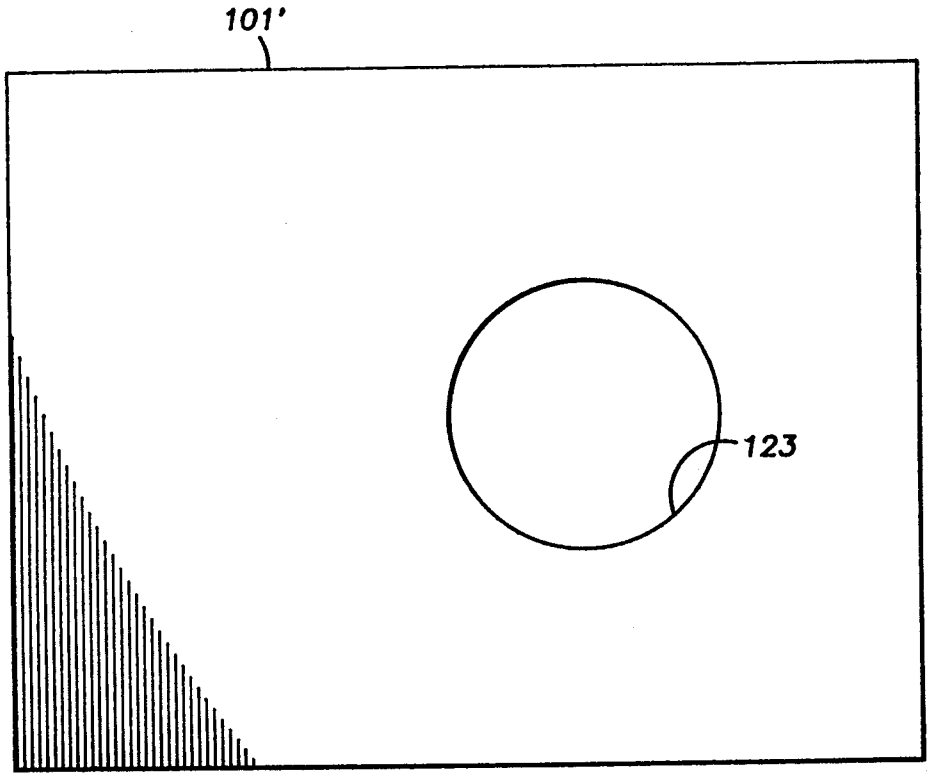
Figure 4B:
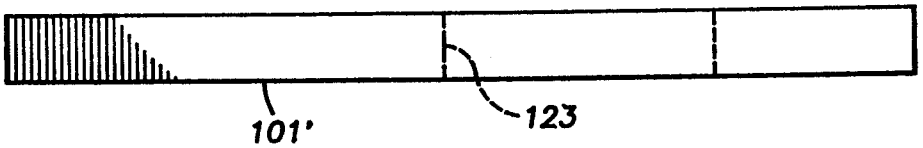
Figure 5C:
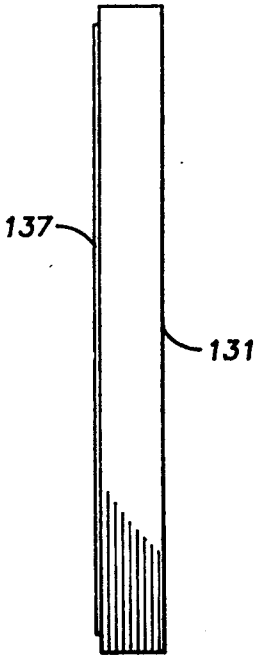
FIGS. 5A, 5B, and 5C are plan, side elevational, and end elevational views, respectively, of a lower box section for a cover of a preferred embodiment of the present invention.
Figure 5D:
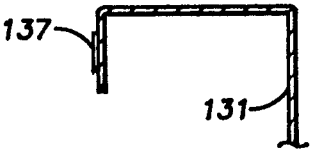
FIG. 5D is a section view taken along lines A—A of FIG. 5A.
Figure 5A:
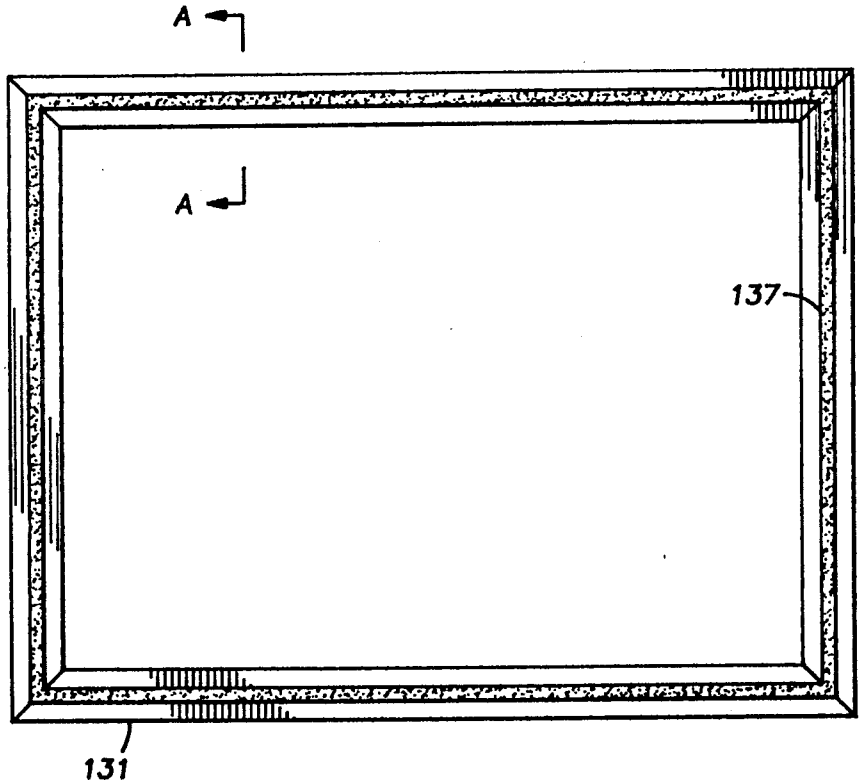
Figure 5B:
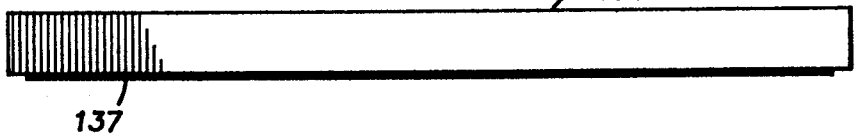
Figure 10:
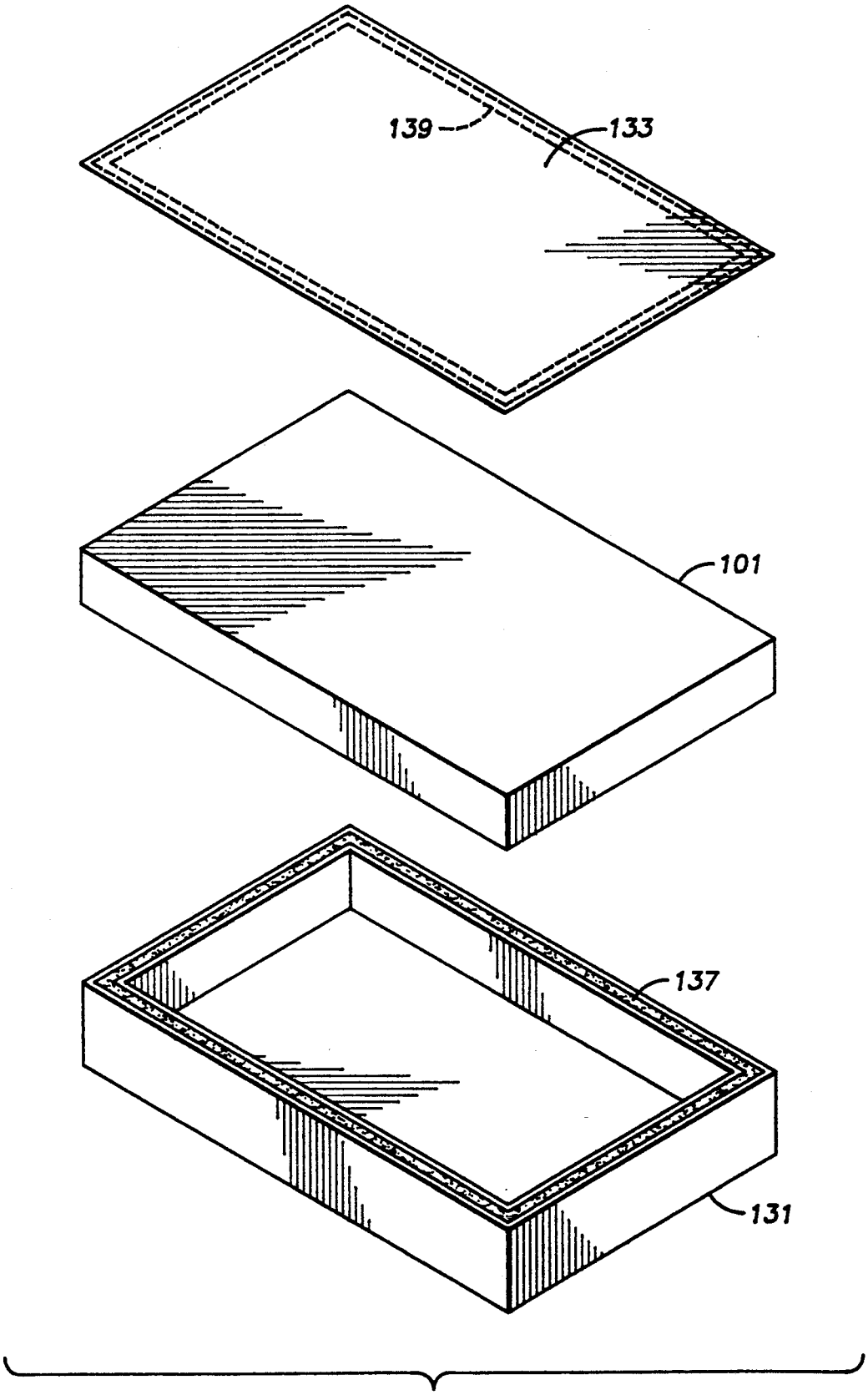
FIG. 10 is an exploded view showing the assembly of one embodiment of a window insulator of the present invention including an insulator core as shown in FIGS. 3A-3C, a lower box section for the cover as shown in FIGS. 5A-5D, and a closure flap as shown in FIGS. 1A-1C.
Figure 11:
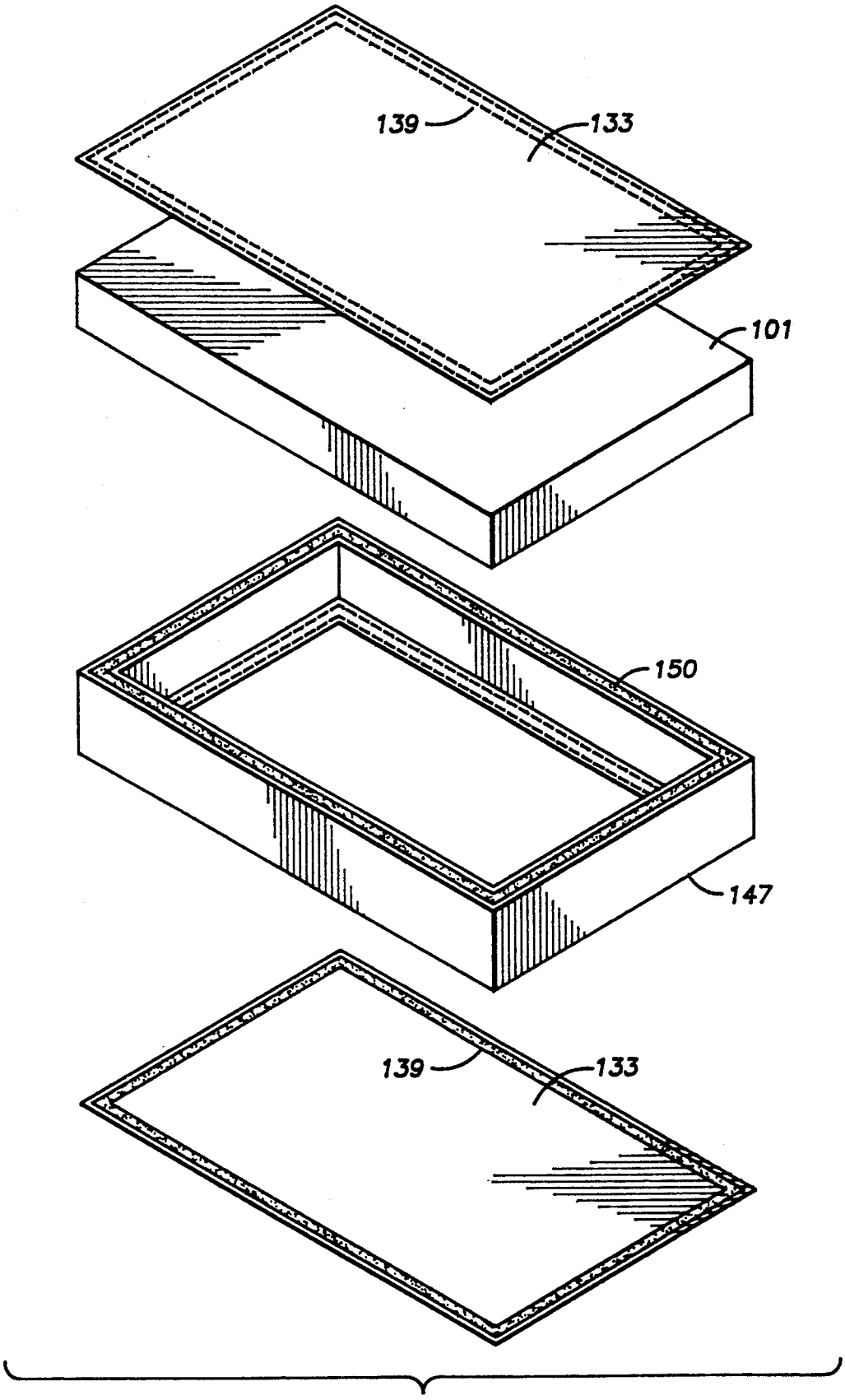
FIG. 11 is an exploded view showing the assembly of another embodiment of a window insulator of the present invention including an insulator core as shown in FIGS. 3A-3C, a middle frame section for the cover as shown in FIGS. 6A-6D, and a pair of closure flaps as shown in FIGS. 1A-1C.
Figure 12:
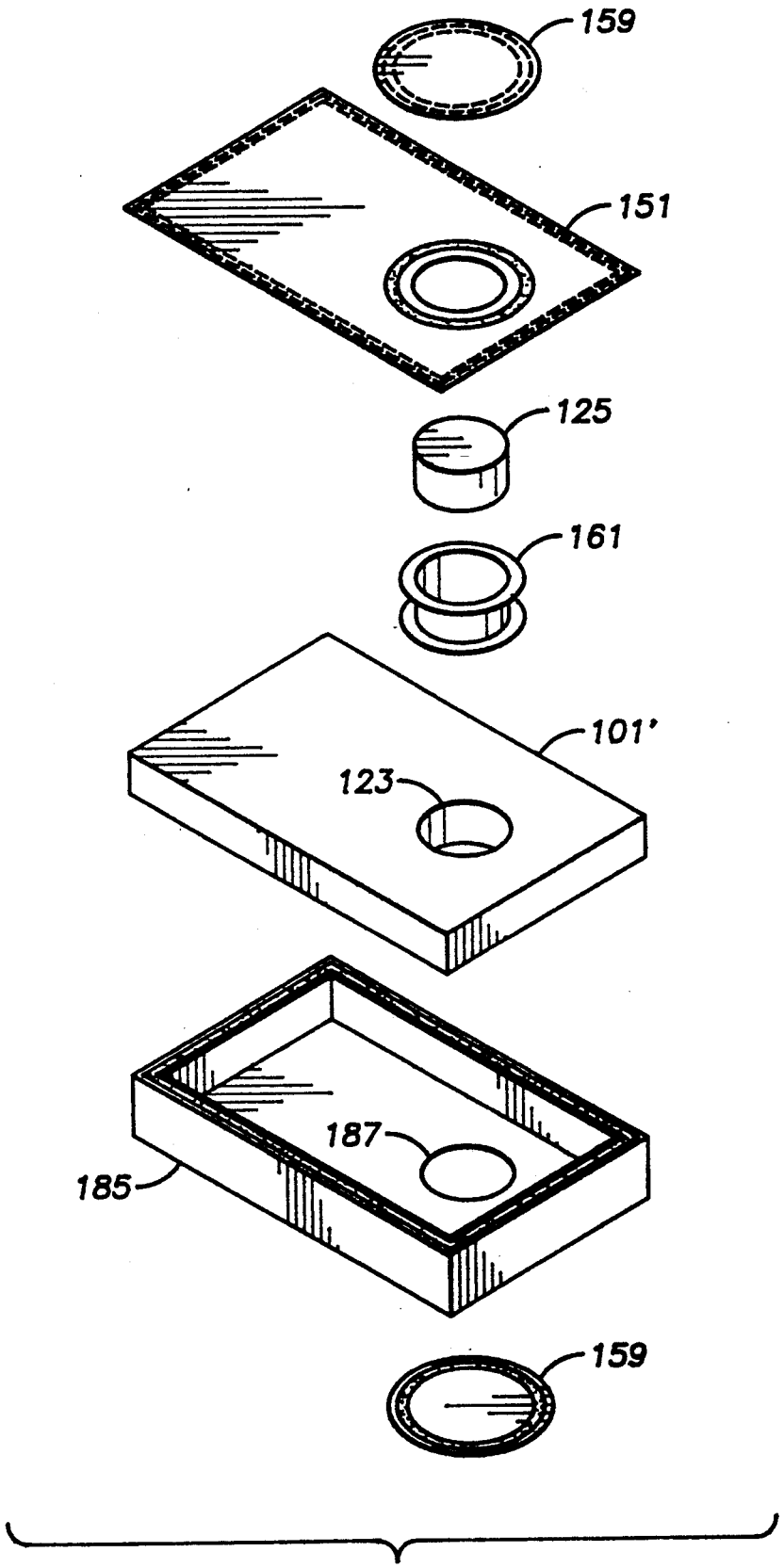
FIG. 12 is an exploded view showing the assembly of another embodiment of a window insulator of the present invention including an insulator core as shown in FIGS. 4A-4C, a lower box section for the cover similar to the one shown in FIGS. 5A-5D but with a hole cut out of its bottom to accommodate a port, a liner for the port as shown in FIGS. 9A and 9B, a plug such as shown in FIGS. 7A-7D (handle not shown), an upper closure flap such as that shown in FIGS. 2A-2D, and a pair of plug closure sections for the cover as shown in FIGS 8A and 8B.
Figure 13:
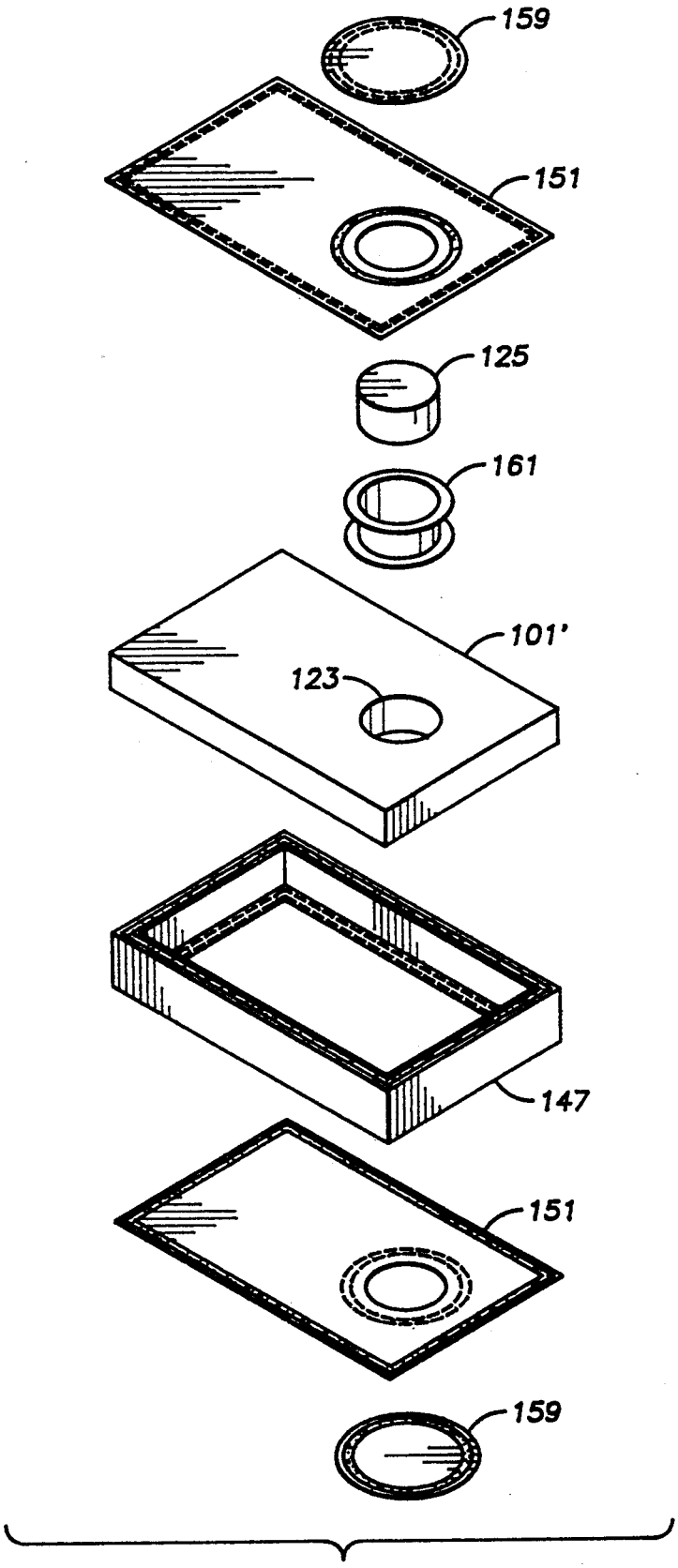
FIG. 13 is an exploded view showing the assembly of another embodiment of a window insulator of the present invention including an insulator core as shown in FIGS. 4A-4C, a middle frame section for the cover as shown in FIGS. 6A-6D, a liner for the port as shown in FIGS. 9A and 9B, a plug such as shown in FIGS. 7A-7D (handle not shown), a pair of closure flaps such as shown in FIGS. 2A-2D, and a pair of plug closure sections for the cover as shown in FIGS. 8A and 8B.

Referring to FIGS. 10, 11, 12, 13, 14 and 16, there are shown Various combinations of the insulator core and cover components discussed above which may be assembled into various embodiments of the invention. FIG. 10 shows one embodiment of a window insulator of the present invention including an insulator core 101 as shown in FIGS. 3A–3C, a lower box section 131 for the cover as shown in FIGS. 5A–5D, and a closure flap 133 as shown in FIGS. 1A–1C. FIG. 11 shows another embodiment of a window insulator of the present invention including an insulator core 101 as shown in FIGS. 3A-3C, a middle frame section 147 for the cover as shown in FIGS. 6A-6D, and a pair of closure flaps 133 as shown in FIGS. 1A-1C. FIG. 12 shows another embodiment of a window insulator of the present invention including an insulator core 101, as shown in FIGS. 4A-4C, a lower box section 185 for the cover similar to the one shown in FIGS. 5A-5D but with a hole 187 cut out of its bottom to accommodate a port, a liner 161 for the port as shown in FIGS. 9A and 9B, a plug 125 such as shown in FIGS. 7A-7D (handle not shown), an upper closure flap 151 such as that shown in FIGS. 2A-2D, and a pair of plug closure sections 159 for the cover as shown in FIGS. 8A and 8B. FIG. 13 shows another embodiment of a window insulator of the present invention including an insulator core 101' as shown in FIGS. 4A-4C, a middle frame section 147 for the cover as shown in FIGS. 6A-6D, a liner 161 for the port as shown in FIGS. 9A and 9B, a plug 125 such as shown in FIGS. 7A-7D (handle not shown), a pair of closure flaps 151 such as shown in FIGS. 2A-2D, and a pair of plug closure sections 159 for the cover as shown in FIGS. 8A and 8B. FIG. 14 shows another alternative embodiment of the window insulator of the present invention, utilizing an insulator core having an inner portion of lightweight rigid insulating material and flexible, resilient foam members affixed, as by an adhesive, to its peripheral edges similar to the one shown in FIGS. 15A AND 15B, and a closure flap for the cover having corner retaining flaps 171 on its inner face for receiving the sheet 173 of additional insulating material, this embodiment also including a port 191 in the core, a plug 125 for the port, a port liner 161 for the cover, a hole 193 in the box section 195 of the cover, and plug closure sections 159 for the cover. FIG. 16 shows another alternative embodiment of a window insulator of the present invention, including an insulator core 103 such as shown in FIGS. 15A and 15B, a box section 131 for the cover as shown in FIGS. 5A-5D, and a closure flap having means 171, 181 for retaining sheet 177 of additional insulating material therewithin.

As indicated above, the window insulator of the present invention should be made slightly larger in overall dimensions than the window enclosure into which it will be placed, so that when the insulator is compressed slightly to fit into the window enclosure, it will result in a spring-loading effect and better hold the insulator within the window enclosure. As examples only, and not by way of limitation, when covering a window having an enclosure 3 feet wide by 6 feet long by 3 inches thick or deep, the window insulator of the present invention will preferably have dimensions of about 3 feet 1 inch wide by 6 feet 1 inch long by 3 inches thick. The oversize in the length and width measurements of the insulator as compared to the window will vary depending on the size of the window covered and the type of materials used for the insulator, but will typically be of the order of a fraction of an inch up to several inches, for example, from one-eighth inch up to two inches, in extra dimension. The placement of the fastening means, such as the Velcro strips, snaps, zipper, ties, or the like, on the covers with respect to the edges of the respective faces will vary depending on size or type of fastener, size of window insulator, and/or type of cover material. Of course, the dimensions shown in the accompanying drawings are merely illustrative, and not limiting. In addition, particularly with reference to FIGS. 12, 13, and 14, a plug 125 can be combined with a plug cover 159 into essentially one piece, so that the plug will have a handle, if desired, and also an integral annular flange with a fastening means such as a Velcro strip disposed on the underside of the flange lip, to mate with the correlatively shaped fastener on the cover flap 151 or the like. It should also be understood that in the event the plug were covered with material, the lower plug cover 159 may not be necessary.

Although the foregoing describes preferred embodiments of the invention, the examples set out in the preceding description are for illustrative purposes only, and are not intended to be limiting. One skilled in the art will no doubt discover that modifications to the particular apparatus disclosed herein may be made without departing from the spirit of the invention. Accordingly, the scope of the present invention should only be determined through consideration and construction of the following claims.

I claim:

1. A sunlight blocking window insulator for placement within a window enclosure, comprising:

an opaque insulator core composed of a substantially solid inner core portion of a lightweight rigid acoustic and thermal insulating material and a plurality of flexible, resilient acoustic and thermal insulating material members affixed to the peripheral edges of said inner core portion, said insulator core being sized so as to be slightly larger than the window enclosure, said flexible, resilient insulating material members of said insulator core forming an environmrntal seal against the window enclosure when installed therewithin, said insulator core comprising means serving as an effective acoustic and thermal insulator, as well as a means of substantially blocking entry of light through the enclosed window; and a closely fitted, flexible cover for removably enclosing the insulator core for placement as a unit within the window enclosure, said cover being adapted to permit said insulator core to flex as necessary to frictionally engage said window enclosure, and for protecting and enhancing the appearance of said window insulator when installed.

2. A window insulator according to claim 1, wherein said insulator core is effective as an acoustic and a thermal insulator.

3. A window insulator according to claim 1, wherein said insulator core is composed of a flexible, resilient foamed plastic material.

4. A window insulator according to claim 3, wherein said insulator core is composed of flexible polyurethane.

5. A window insulator according to claim 1, wherein said insulator core is composed of rigid polyethylene.

6. A window insulator according to claim 1, wherein said insulator core is composed of rigid polyurethane.

7. A window insulator according to claim 1, and further including a port through the insulator core, and an aperture in said cover in register with the port.

8. A window insulator according to claim 7, and further including a plug of said hand-compressible insulating material, said plug being removably received within said port.

9. A window insulator according to claim 8, and further including a port liner disposed within said port, said port liner being comprised within said cover.

10. A window insulator according to claim 9, wherein said port liner comprises a cylindrical body portion receivable in said port and a flanged portion at each end for attachment to an adjacent face of said cover.

11. A window insulator according to claim 1, wherein said cover includes a lower box section for enclosing said insulator core on all of its sides and faces but one primary face of said insulator core, said lower box section partially enclosing said one primary face with a border extending inwardly from its outer peripheral edges, and a closure flap removably mountable on said border of said lower box section for enclosing the remainder of said one primary face within said cover.

12. A window insulator according to claim 11, including a port through the insulator core, an aperture in said closure flap in register with said port, and an aperture in the bottom of said box section also in register with said port.

13. A window insulator according to claim 12, and further including plug closure sections removably mountable on the exterior sides of said closure flap and said bottom of said box section for closing said apertures.

14. A window insulator according to claim 1, wherein said cover includes a middle frame portion for enclosing the edges of said insulator core and border portions extending inwardly from the peripheral edges of said middle frame portion for partially enclosing the opposite primary faces of said insulator core, and a pair of closure flaps removably mountable on said border portions of said middle frame portion of said cover for enclosing the remainder of said opposite primary faces of said core within said cover.

15. A window insulator according to claim 11, wherein said closure flap is removably mounted on said box section of said cover with Velcro fasteners.

16. A window insulator according to claim 14, wherein said closure flaps are removably mounted on said middle frame portion of said cover with Velcro fasteners.

17. A window insulator according to claim 11, wherein said closure flap includes corner flaps on its interior side for receiving a sheet of additional insulating material within said corner flaps.

18. A window insulator according to claim 17, and further including a transverse strap at the midportion of said interior side of said closure flap for providing additional support for said sheet of additional insulating material.

19. A sunlight-blocking window insulator for placement within a window enclosure, comprising:

an opaque insulator core composed of a substantially solid inner core portion of a lightweight rigid acoustic and thermal insulating material and a plurality of flexible, resilient acoustic and thermal insulating material members affixed to the peripheral edges of said inner core portion, said insulator core being sized so as to be slightly larger than the window enclosure, said flexible, resilient insulating material members of said insulator core forming an environmental seal against the window enclosure when installed therewithin, said insulator core comprising means serving as an effective acoustic and thermal insulator, as well as a means of substantially blocking entry of light through the enclosed window; and a closely fitted, flexible cover for removably enclosing the insulator core for placement as a unit within the window enclosure, said cover being adapted to permit said insulator core to flex as necessary to frictionally engage said window enclosure, and for protecting and enhancing the appearance of said window insulator when installed.

20. A window insulator according to claim 19, wherein said inner core portion is composed of a rigid polyurethane material.

21. A window insulator according to claim 19, wherein said inner core portion is composed of rigid polystyrene foam.

22. A window insulator according to claim 19, wherein said inner core portion is composed of a rigid polyethylene material.

23. A window insulator according to claim 19, wherein said flexible, resilient insulating material members are composed of a flexible foamed plastic material.

24. A window insulator according to claim 19, wherein said flexible, resilient insulating material members are composed of flexible polyurethane.

25. A window insulator according to claim 19, wherein said flexible, resilient insulating material members are mounted to said inner core portion with an adhesive.

26. A sunlight-blocking window insulator for placement within a window enclosure, comprising:

an opaque insulator core composed of an inner core portion of a lightweight rigid insulating material and a plurality of flexible, resilient insulating material members affixed to the peripheral edges of said inner core portion, said insulator core being sized so as to be slightly larger than the window enclosure, said flexible, resilient insulating material members of said insulator core forming an environmental seal against the window enclosure when installed therewithin; and a cover for removably enclosing the insulator core, and wherein said flexible, resilient insulating material members are mounted to said inner core portion with a saddle comprising an inverted U-shaped fabric channel mounted atop an inverted U-shaped fabric skirt, said fabric of said skirt being relatively more heavy-duty than said fabric of said channel, the opposite sides of said skirt being mounted on the opposite sides of said inner core portion.

27. A window insulator according to claim 26, wherein said skirt comprises a central inverted U-shaped portion and a pair of longitudinally extending flaps on each end thereof, the central portion being substantially the same length as the flexible, reislient insulating material members.

28. A window insulator according to claim 27, wherein said skirt is made of canvas, and said channel portion of said saddle is made of netting.

29. A window insulator according to claim 27, wherein said skirt is stitched to said inner core portion with twine.

* * * * *

UNITED STATES PATENT AND TRADEMARK OFFICE

CERTIFICATE OF CORRECTION

PATENT NO. : 5,203,129

DATED : April 20, 1993

INVENTOR(S) : Brenis E. Johnson

It is certified that error appears in the above—identified patent and that said Letters Patent is hereby corrected as shown below:

Title Page (56) References cited -

| | | | |
|---|---|---|---|
| Add: | 4,317,244 | 3/1982 | Balfour - Richie |
| | 4,687,039 | 8/1987 | Chumbley |
| | 4,733,902 | 3/1988 | Rabb |
| | 4,777,681 | 10/1988 | Luck, et al. |
| | 4,809,375 | 3/1989 | Bull |
| | 4,818,590 | 4/1989 | Prince, et al. |

Column 5, line 37, after "FIG." delete--1--and insert--14--.

Signed and Sealed this

Tenth Day of May, 1994

Bruce Lehman

*Attest:*

BRUCE LEHMAN

*Attesting Officer*

*Commissioner of Patents and Trademarks*